US010697458B2

(12) United States Patent
Pham et al.

(10) Patent No.: US 10,697,458 B2
(45) Date of Patent: Jun. 30, 2020

(54) DIAGNOSTIC SYSTEM

(71) Applicant: Emerson Climate Technologies, Inc., Sidney, OH (US)

(72) Inventors: Hung M. Pham, Dayton, OH (US); Nagaraj Jayanth, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 146 days.

(21) Appl. No.: 16/036,331

(22) Filed: Jul. 16, 2018

(65) Prior Publication Data

US 2018/0320690 A1 Nov. 8, 2018

Related U.S. Application Data

(63) Continuation of application No. 12/781,044, filed on May 17, 2010, now Pat. No. 10,024,321.
(Continued)

(51) Int. Cl.
*F04C 28/28* (2006.01)
*F04B 49/06* (2006.01)
(Continued)

(52) U.S. Cl.
CPC ..... *F04C 28/28* (2013.01); *F04B 49/065* (2013.01); *F04B 51/00* (2013.01);
(Continued)

(58) Field of Classification Search
CPC ..... F04C 28/28; F04C 28/00; F04C 2270/86; F04C 2270/80; F04C 2270/07;
(Continued)

(56) References Cited

U.S. PATENT DOCUMENTS 3,796,062 A 3/1974 Stewart
4,877,382 A 10/1989 Caillat et al.
(Continued)

FOREIGN PATENT DOCUMENTS

CA 2760487 A1 11/2010
CN 2152192 Y 1/1994
(Continued)

OTHER PUBLICATIONS

International Search Report regarding Application No. PCT/US2010/035208, dated Jan. 5, 2011.
(Continued)

*Primary Examiner* — Emmanuel E Duke
(74) *Attorney, Agent, or Firm* — Harness, Dickey & Pierce, P.L.C.

(57) ABSTRACT

A diagnostic system for a compressor is provided. The compressor includes a compression mechanism and a motor. The diagnostic system includes processing circuitry and memory and may be operable to differentiate between a low-side fault and a high-side fault by monitoring a rate of current rise drawn by the motor for a first predetermined time period following compressor startup. The diagnostic system may be operable to predict a severity level of a compressor condition based on a fault history stored in the memory.

20 Claims, 12 Drawing Sheets

Related U.S. Application Data

(60) Provisional application No. 61/179,221, filed on May 18, 2009.

(51) Int. Cl.
*F04B 51/00* (2006.01)
*F04C 18/02* (2006.01)
*F04C 23/00* (2006.01)

(52) U.S. Cl.
CPC ..... *F04C 18/0215* (2013.01); *F04C 23/008* (2013.01); *F04C 2240/81* (2013.01); *F04C 2270/07* (2013.01); *F04C 2270/80* (2013.01); *F04C 2270/86* (2013.01)

(58) Field of Classification Search
CPC ..... F04C 2240/81; F04C 23/008; F04C 18/0215; F04B 51/00; F04B 49/065
See application file for complete search history.

(56) References Cited

U.S. PATENT DOCUMENTS

| | | | | |
|---|---|---|---|---|
| 5,102,316 | A | 4/1992 | Caillat et al. | |
| 5,123,253 | A | 6/1992 | Hanson et al. | |
| 5,320,506 | A | 6/1994 | Fogt | |
| 5,321,957 | A | 6/1994 | Moore | |
| 5,512,883 | A | 4/1996 | Lane, Jr. | |
| 5,678,985 | A | 10/1997 | Brooke et al. | |
| 5,690,475 | A | 11/1997 | Yamada et al. | |
| 5,754,450 | A * | 5/1998 | Solomon | G01M 15/00 324/765.01 |
| 6,406,265 | B1 * | 6/2002 | Hahn | F04C 23/008 417/19 |
| 6,412,293 | B1 | 7/2002 | Pham et al. | |
| 6,457,948 | B1 * | 10/2002 | Pham | F04C 23/008 417/212 |
| 6,615,594 | B2 | 9/2003 | Jayanth et al. | |
| 6,748,304 | B2 | 6/2004 | Felke et al. | |
| 6,758,050 | B2 | 7/2004 | Jayanth et al. | |
| 7,027,953 | B2 | 4/2006 | Klein | |
| 7,260,948 | B2 * | 8/2007 | Jayanth | B25J 9/1687 62/125 |
| 7,290,989 | B2 | 11/2007 | Jayanth | |
| 7,412,842 | B2 | 8/2008 | Pham | |
| 7,477,960 | B2 | 1/2009 | Willis et al. | |
| 2001/0049942 | A1 | 12/2001 | Pham et al. | |
| 2002/0141877 | A1 * | 10/2002 | Jayanth | B25J 9/1687 417/63 |
| 2004/0064212 | A1 | 4/2004 | Samata et al. | |
| 2005/0196285 | A1 * | 9/2005 | Jayanth | F04C 23/008 417/44.11 |
| 2005/0220628 | A1 | 10/2005 | Pervaiz | |
| 2005/0235660 | A1 * | 10/2005 | Pham | F04C 28/00 62/126 |
| 2005/0247073 | A1 | 11/2005 | Hikawa et al. | |
| 2008/0209925 | A1 * | 9/2008 | Pham | F25B 49/022 62/126 |
| 2008/0264080 | A1 | 10/2008 | Creed et al. | |
| 2008/0303477 | A1 | 12/2008 | Patel | |
| 2009/0071175 | A1 * | 3/2009 | Pham | F25B 49/005 62/129 |
| 2010/0080713 | A1 | 4/2010 | Douglas et al. | |
| 2010/0090713 | A1 | 4/2010 | Geisel | |

FOREIGN PATENT DOCUMENTS

| | | | |
|---|---|---|---|
| CN | 1378320 | A | 11/2002 |
| CN | 101052847 | A | 10/2007 |
| CN | 102428277 | A | 4/2012 |
| EP | 1541869 | A1 | 6/2005 |
| EP | 2433007 | A2 | 3/2012 |
| JP | S5793695 | A | 6/1982 |
| WO | WO-2005065355 | A2 | 7/2005 |
| WO | WO-2006025880 | A1 | 3/2006 |
| WO | WO-2009105642 | A2 | 8/2009 |
| WO | WO-2010135290 | A2 | 11/2010 |

OTHER PUBLICATIONS

Written Opinion of the International Searching Authority regarding Application No. PCT/US2010/035208, dated Jan. 5, 2011.
Office Action regarding Korean Patent Application No. 10-2011-7028815, dated Mar. 25, 2013. English language translation provided by Y. S. Chang & Associates.
Non-Final Office Action regarding U.S. Appl. No. 12/781,044, dated Apr. 3, 2013.
Office Action regarding Israel Patent Application No. 216457, dated Jun. 9, 2013. Translation provided by Elrlich & Fenster Patent & Trademark Attorneys.
Final Office Action regarding U.S. Appl. No. 12/781,044, dated Jul. 30, 2013.
First Office Action and Search Report regarding Chinese Patent Application for Invention No. 201080022089.1, dated Oct. 17, 2013. English-language translation provided by Unitalen Attorneys at Law.
Non-Final Office Action regarding U.S. Appl. No. 12/781,044, dated Oct. 22, 2013.
Second Preliminary Notice of Grounds for Rejection regarding Korean Patent Application No. 10-2011-7028815, dated Oct. 30, 2013. English language translation provided by Y. S. Chang & Associates.
Office Action regarding Mexican Patent Application No. MX/a/2011/011258, dated Feb. 14, 2014.
Final Office Action regarding U.S. Appl. No. 12/781,044, dated Feb. 27, 2014.
Third Preliminary Notice of Grounds for Rejection regarding Korean Patent Application No. 10-2011-7028815, dated Apr. 25, 2014. English language translation provided by Y. S. Chang & Associates.
Second Office Action and Search Report regarding Chinese Patent Application for Invention No. 201080022089.1, dated Jun. 10, 2014. English-language translation provided by Unitalen Attorneys at Law.
Office Action regarding Australian Patent Application No. 2010249784, dated Jul. 3, 2014.
Office Action regarding Canadian Patent Application No. 2852391 dated Jul. 17, 2014.
Office Action regarding Israel Patent Application No. 216457 dated Jul. 31, 2014. Translation provided by Ehrlich & Fenster.
Non-Final Office Action regarding U.S. Appl. No. 12/781,044, dated Aug. 15, 2014.
Preliminary Notice of Grounds for Rejection regarding Korea Application No. 10-2014-7017130 dated Sep. 11, 2014. Translation provided by Y.S. Chang & Associates.
Final Office Action regarding U.S. Appl. No. 12/781,044 dated Dec. 9, 2014.
Office Action regarding Chinese Patent Application No. 201080022089.1 dated Dec. 15, 2014. Translation provided by Unitalen Attorneys at Law.
Final Office Action regarding U.S. Appl. No. 12/781,044 dated Feb. 9, 2015.
Office Action regarding Korean Patent Application No. 10-2014-7017130, dated Mar. 19, 2015. Translation provided by Y.S. Chang & Associates.
Advisory Action regarding U.S. Appl. No. 12/781,044, dated Apr. 17, 2015.
Office Action regarding Israel Patent Application No. 216457, dated Jun. 15, 2015. Translation provided by Ehrlich & Fenster Patent & Trademark Attorneys.
Office Action regarding Canadian Patent Application No. 2,852,391, dated Jun. 25, 2015.
Search Report regarding European Patent Application No. 10778239.3, dated Nov. 10, 2015.
Office Action regarding Australian Patent Application No. 2015264878, dated Jun. 20, 2016.

(56) References Cited

OTHER PUBLICATIONS

Office Action regarding Chinese Patent Application No. 201510438090.7, dated Jun. 21, 2016. Translation provided by Unitalen Attorneys at Law.
Office Action regarding Canadian Patent Application No. 2,852,391, dated Jun. 22, 2016.
Office Action regarding Chinese Patent Application No. 201510438095.X, dated Dec. 2, 2016. Translation provided by Unitalen Attorneys at Law.
Office Action regarding Chinese Patent Application No. 201510438090.7, dated Mar. 21, 2017. Translation provided by Unitalen Attorneys at Law.
Office Action regarding Canadian Patent Application No. 2,852,391, dated May 19, 2017.
Office Action regarding Chinese Patent Application No. 201510438095.X, dated Aug. 2, 2017. Translation provided by Unitalen Attorneys at Law.
Office Action regarding Chinese Patent Application No. 201510438090.7, dated Sep. 27, 2017. Translation provided by Unitalen Attorneys at Law.
Office Action regarding Chinese Patent Application No. 201510438095.X, dated Nov. 16, 2017. Translation provided by Unitalen Attorneys at Law.
Office Action regarding Indian Patent Application No. 2118/MUMNP/2011, dated Feb. 13, 2018.
Office Action regarding European Patent Application No. 10778239.3, dated Apr. 30, 2018.
Office Action regarding Indian Patent Application No. 2118/MUMNP/2011, dated Feb. 20, 2020.

* cited by examiner

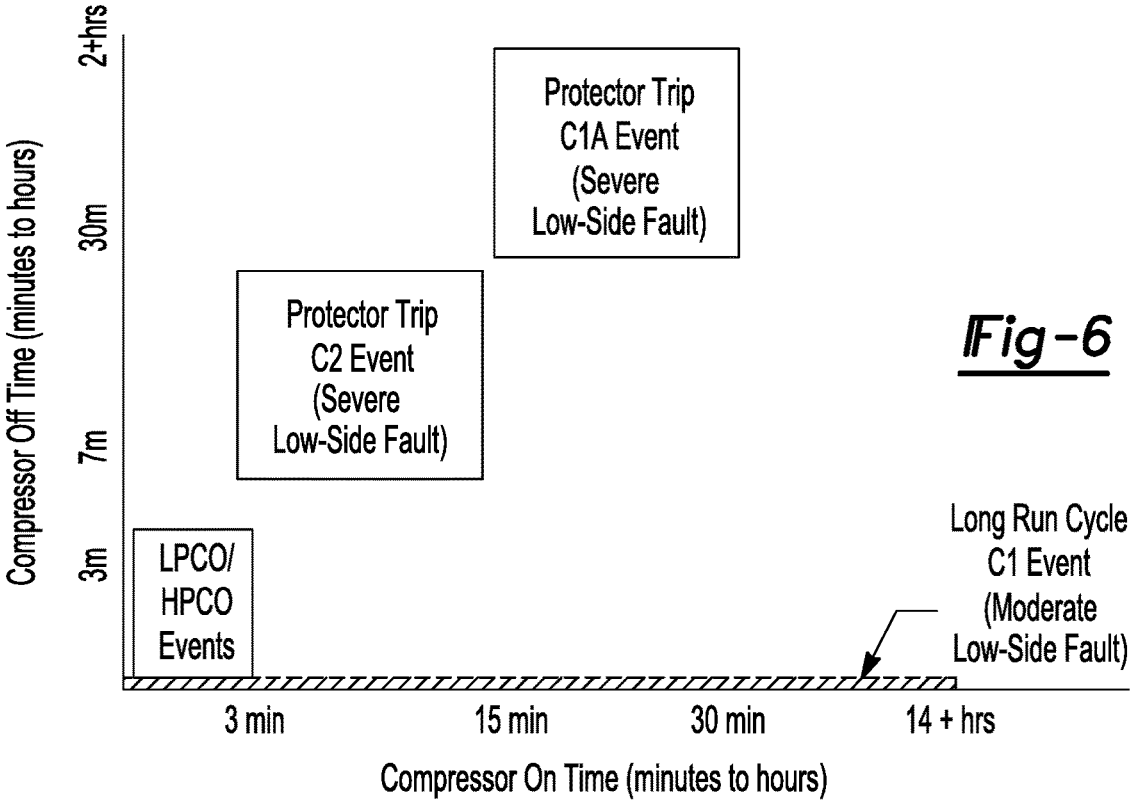

Fig-6

| | Fault Events | Y | Running Current Signature | | Compressor On Time | Compressor Off Time |
|---|---|---|---|---|---|---|
| High Side | HPCO | Cycling | ↑ | >1.4x | < 3 min | < 7 min |
| | C2 Protector Trip | On | ↑ | | < 15 min | > 7 min |
| | C4 Low oil | On | ↑ | | < 15 sec or Sudden Current Incr. | |
| Low Side | LPCO | Cycling | ↓ | <1.1x | < 3 min | < 7 min |
| | C1A Protector Trip | On | ↓ | | > 30 min | > 7 min |
| | C4 Low oil | On | ↓ | | < 15 sec or Sudden Current Incr. | |

- 1st 3-min Current Signature Differentiates Low-Side vs. High Side Faults
- Compressor On Time and Compressor Off Time Provides Additional Differentiation Amongst Element (82, 84, 91)
- Higher Magnitude of Current Rise Indicates Increasing High-Side Fault Severity
- Shorter Compressor On Time With No Current Rise Indicates Increasing Low-Side Fault/Condition Severity

Fig-7

DIAGNOSTIC SYSTEM

CROSS-REFERENCE TO RELATED APPLICATIONS

This application is a continuation of U.S. patent application Ser. No. 12/781,044 filed on May 17, 2010, which claims the benefit of U.S. Provisional Application No. 61/179,221, filed on May 18, 2009. The entire disclosures of the above applications are incorporated herein by reference.

FIELD

The present disclosure relates to diagnostic systems, and more particularly, to a diagnostic system for use with a compressor and/or refrigeration system.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing applications, the compressor should provide consistent and efficient operation to ensure that the particular refrigeration system functions properly.

Refrigeration systems and associated compressors may include a protection device that intermittently restricts power to the compressor to prevent operation of the compressor and associated components of the refrigeration system (i.e., evaporator, condenser, etc.) when conditions are unfavorable. For example, when a particular fault is detected within the compressor, the protection device may restrict power to the compressor to prevent operation of the compressor and refrigeration system under such conditions.

The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor and, thus, may cause malfunction of, and possible damage to, the compressor.

In addition to electrical and mechanical faults associated with the compressor, the refrigeration system components may be affected by system faults attributed to system conditions such as an adverse level of fluid disposed within the system or to a blocked-flow condition external to the compressor. Such system conditions may raise an internal compressor temperature or pressure to high levels, thereby damaging the compressor and causing system inefficiencies and/or malfunctions. To prevent system and compressor damage or malfunctions, the compressor may be shut down by the protection system when any of the aforementioned conditions are present.

Conventional protection systems may sense temperature and/or pressure parameters as discrete switches to interrupt power supplied to the electrical motor of the compressor should a predetermined temperature or pressure threshold be exceeded. Such protection systems, however, are "reactive" in that they react to compressor and/or refrigeration-system malfunctions and do little to predict or anticipate future malfunctions.

SUMMARY

A compressor is provided and may include a shell, a compression mechanism, a motor, and a diagnostic system. The diagnostic system may include a processor and a memory and may differentiate between a low-side fault and a high-side fault by monitoring a rate of current rise drawn by the motor for a first predetermined time period following compressor startup.

The rate of current rise may be determined by calculating a ratio of a running current drawn by the motor during the first predetermined time period over a stored reference current value taken during a second predetermined time period.

The first predetermined time period may be approximately three (3) to five (5) minutes.

The second predetermined time period may be approximately seven (7) to twenty (20) seconds following the compressor startup.

The processing circuitry may declare a high-side fault if the ratio exceeds approximately 1.4 during the first predetermined time period.

The processing circuitry may declare a low-side fault if the ratio is less than approximately 1.1 during the first predetermined time period.

The processing circuitry may predict a severity level of a compressor condition based on at least one of a sequence of historical compressor fault events and a combination of the types of the historical compressor fault events.

The processing circuitry may differentiate amongst cycling of a high-pressure cutout switch, cycling of a low-pressure cutout switch, and cycling of a motor protector based on the rate of current rise in combination with an ON time of the compressor and an OFF time of the compressor.

The rate of current rise may be determined by calculating a ratio of a running current drawn by the motor during the first predetermined time period over a stored reference current value taken during a second predetermined time period.

The processing circuitry may declare a high-side fault if the ratio exceeds approximately 1.4 during the first predetermined time period and may declare a low-side fault if the ratio is less than approximately 1.1 during the first predetermined time period.

A method is provided and may include monitoring a rate of current rise drawn by a compressor motor for a first predetermined time period following compressor start up and differentiating by a processor between a low-side fault and a high-side fault based on the rate of current rise for the first predetermined time period.

The method may additionally include determining a reference current value taken during a second predetermined time period and storing the reference current value in a memory.

The method may additionally include determining by the processor a ratio of running current drawn by the motor during the first predetermined time period over the stored reference current value during the second predetermined time period to determine the rate of current rise. The first predetermined time period may be approximately three (3) to five (5) minutes while the second predetermined time period may be approximately seven (7) to twenty (20) seconds following compressor startup.

The method may additionally include declaring by the processor a high-side fault if the ratio exceeds approximately 1.4 during the first predetermined time period.

The method may additionally include declaring a low-side fault if the ratio is less than approximately 1.1 during the first predetermined time period.

The method may additionally include predicting a severity level of a compressor condition based on at least one of a sequence of historical compressor fault events and a combination of the types of the historical compressor fault events.

The method may additionally include differentiating amongst cycling of a high-pressure cutout switch, cycling of a low-pressure cutout switch, and cycling of a motor protector based on the rate of current rise in combination with an ON time of the compressor and an OFF time of the compressor.

The method may additionally include determining by the processor a ratio of a running current drawn by the compressor during the first predetermined time period over a stored reference current value taken during a second predetermined time period.

The method may additionally include declaring by the processor a high-side fault if the ratio exceeds approximately 1.4 during the first predetermined time period and declaring by the processor a low-side fault if the ratio is less than approximately 1.1 during the first predetermined time period.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4A:
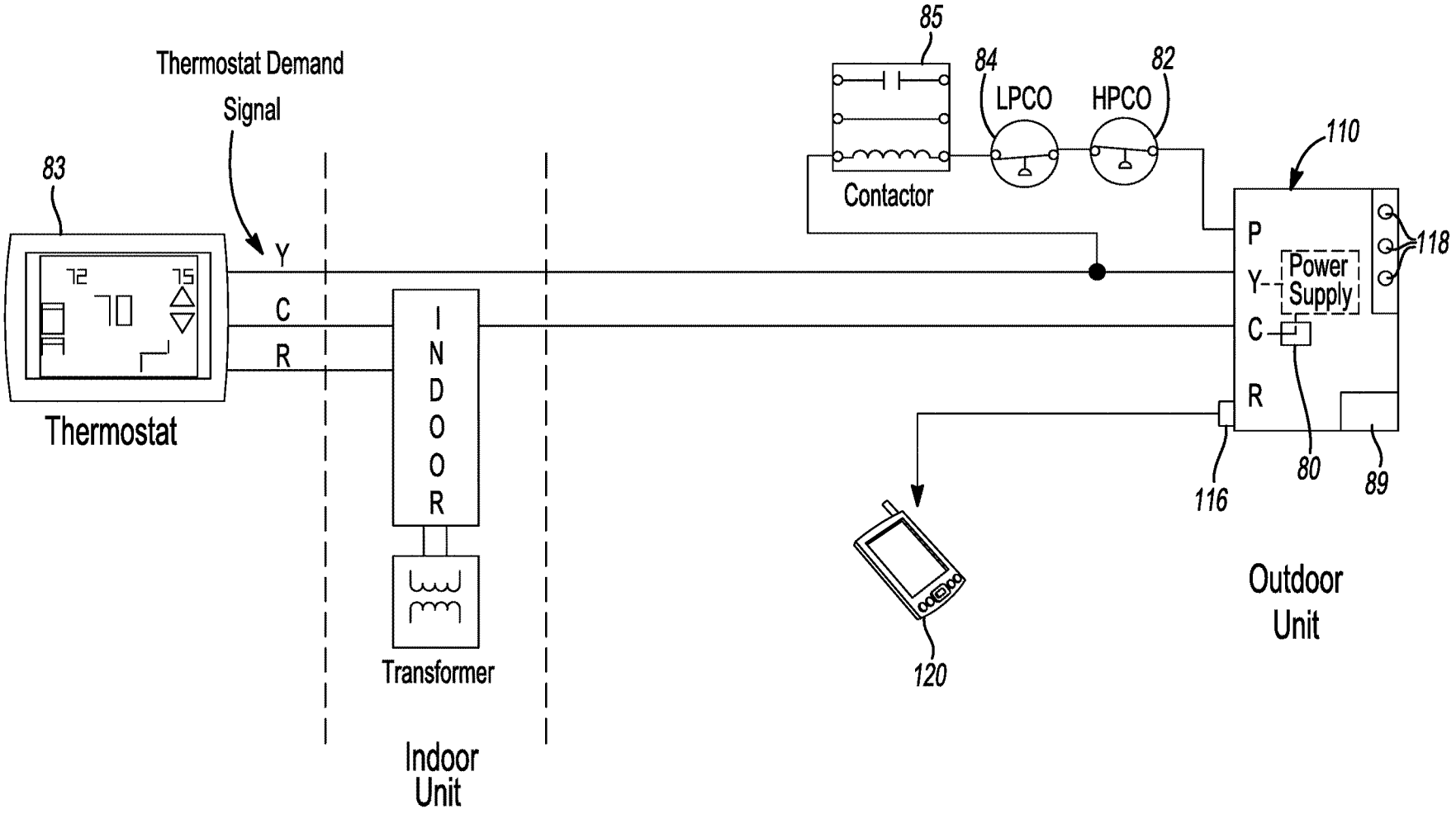
Figure 4B:
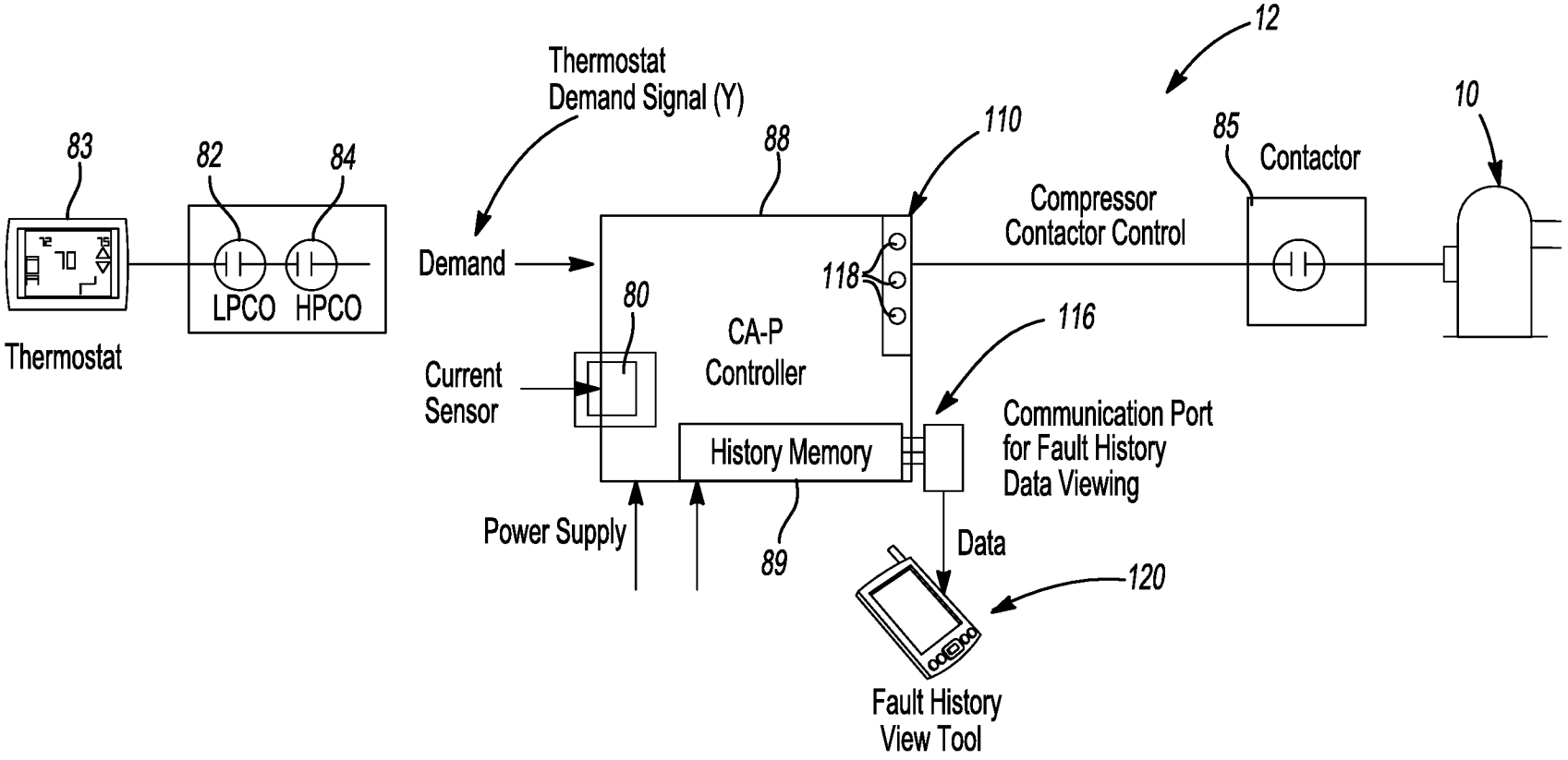
Figure 5:
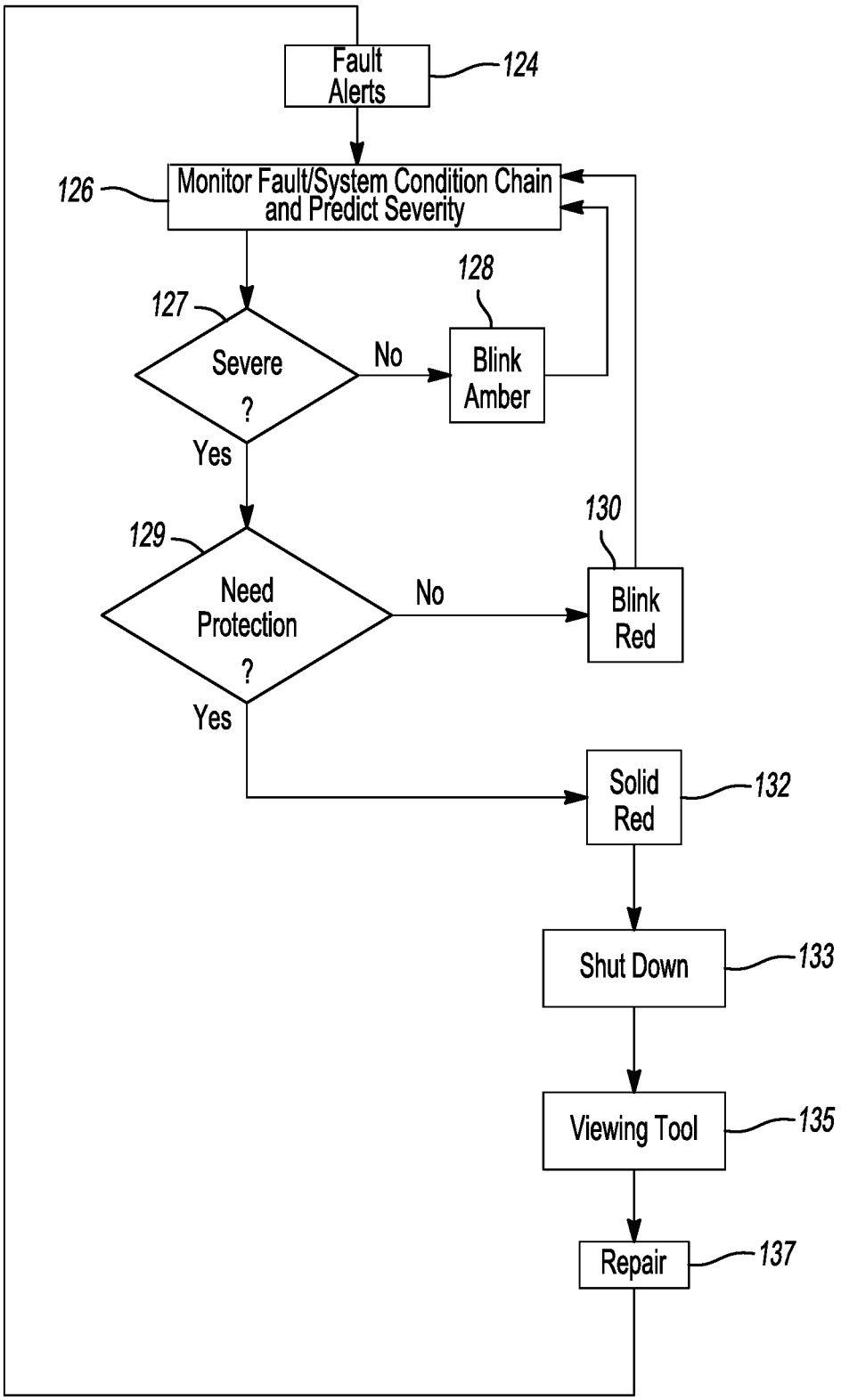
Figure 8:
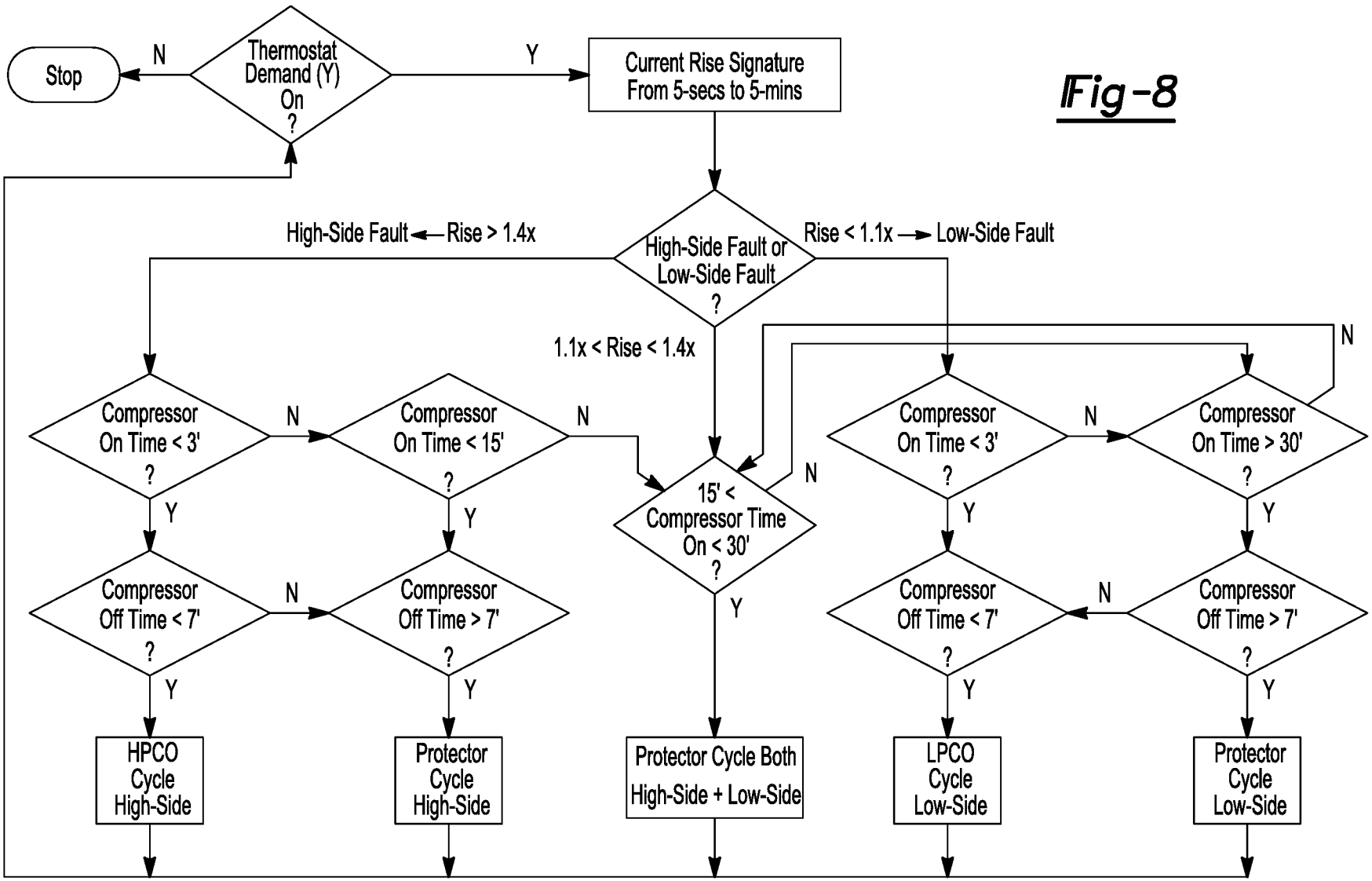
Figure 9:
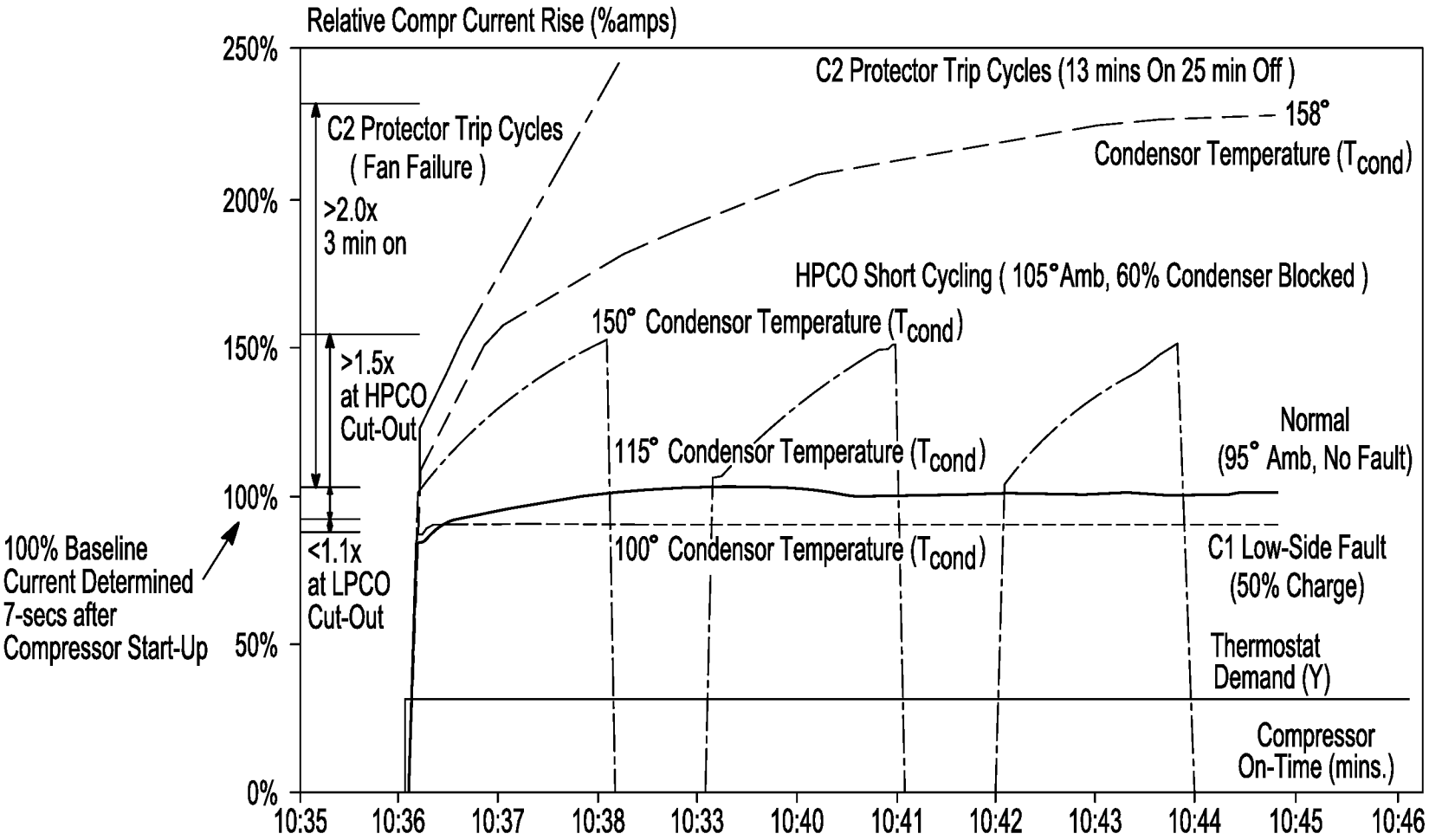
Figure 10:
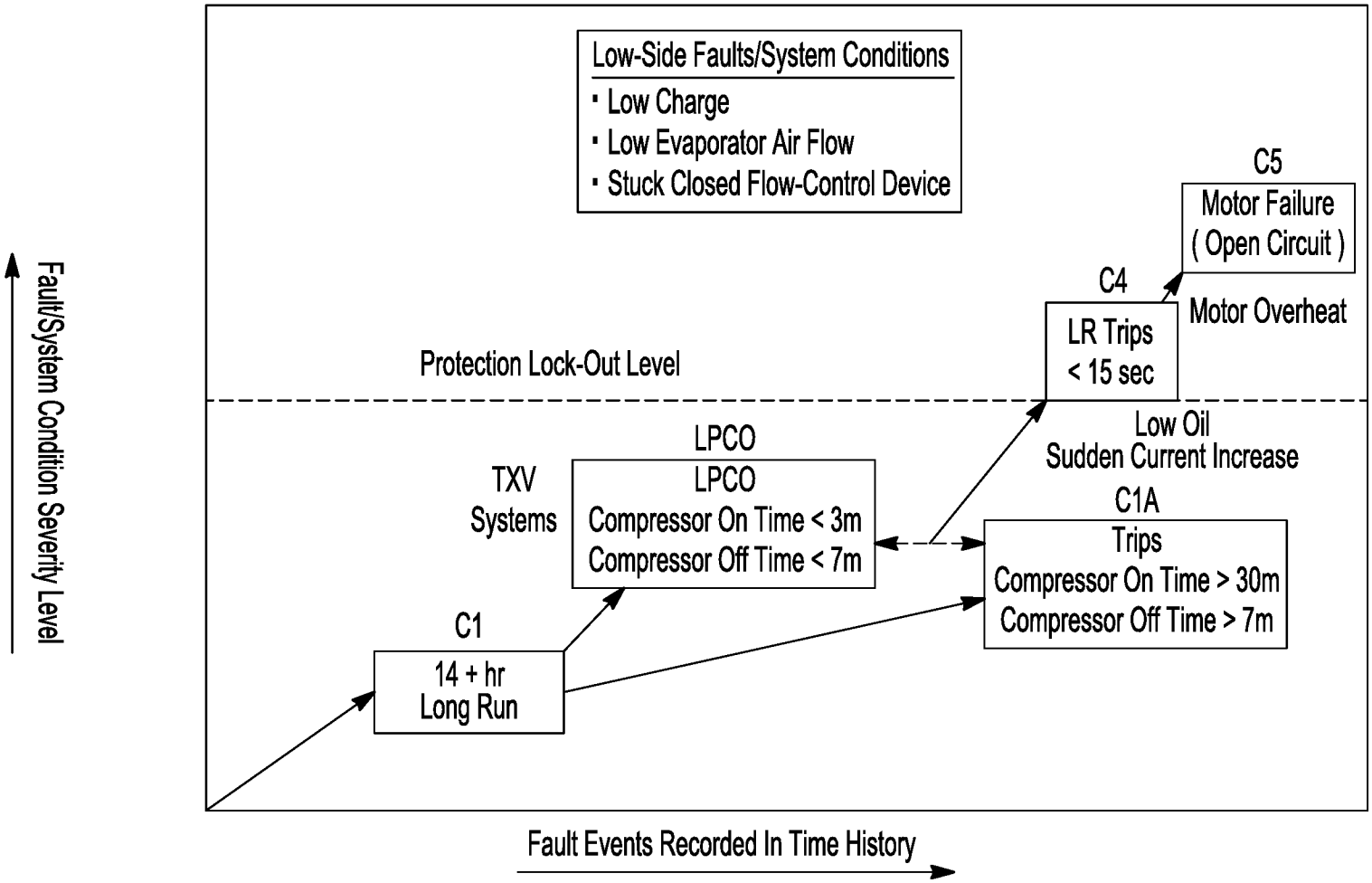
Figure 11:
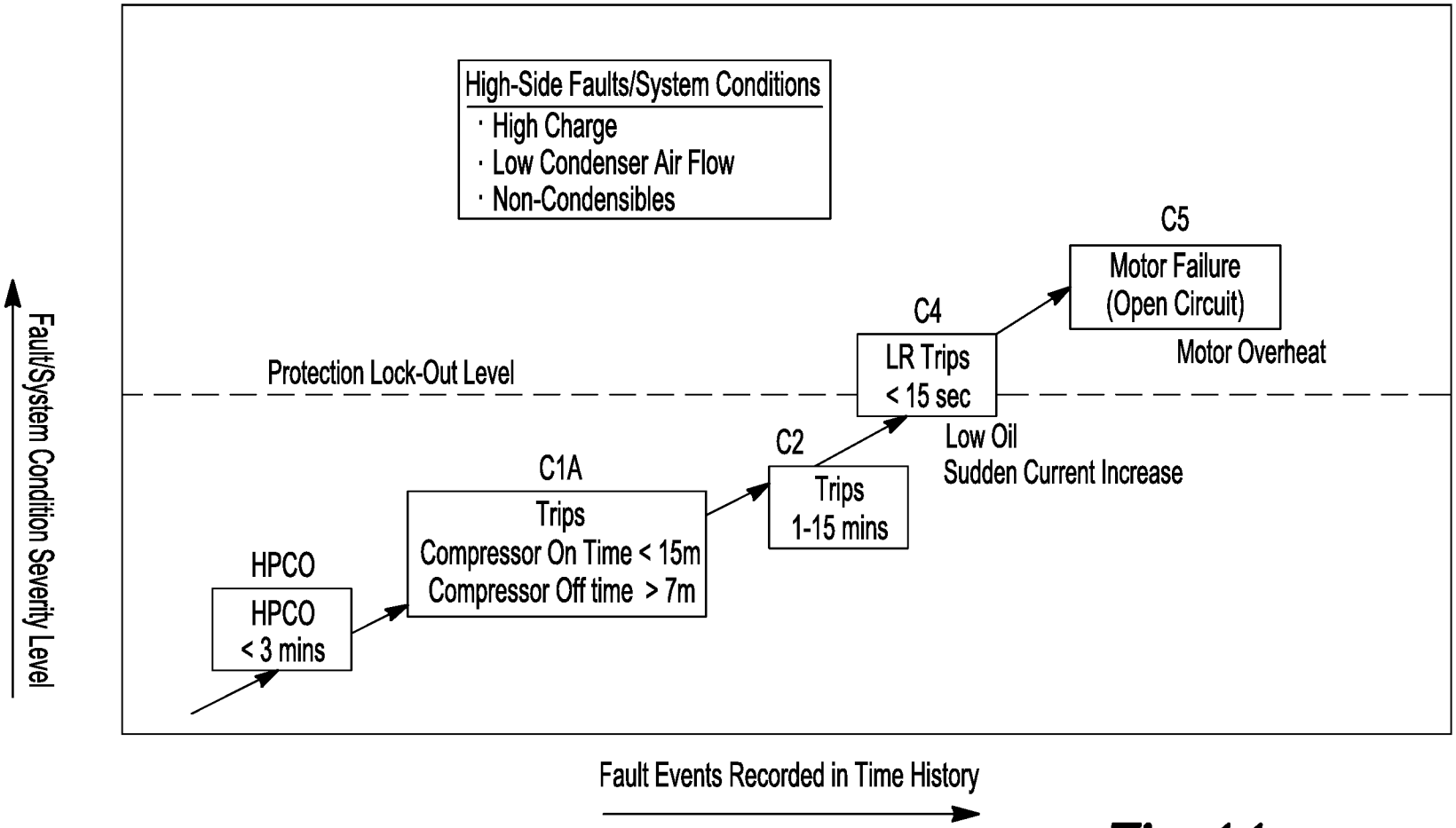
Figure 12:
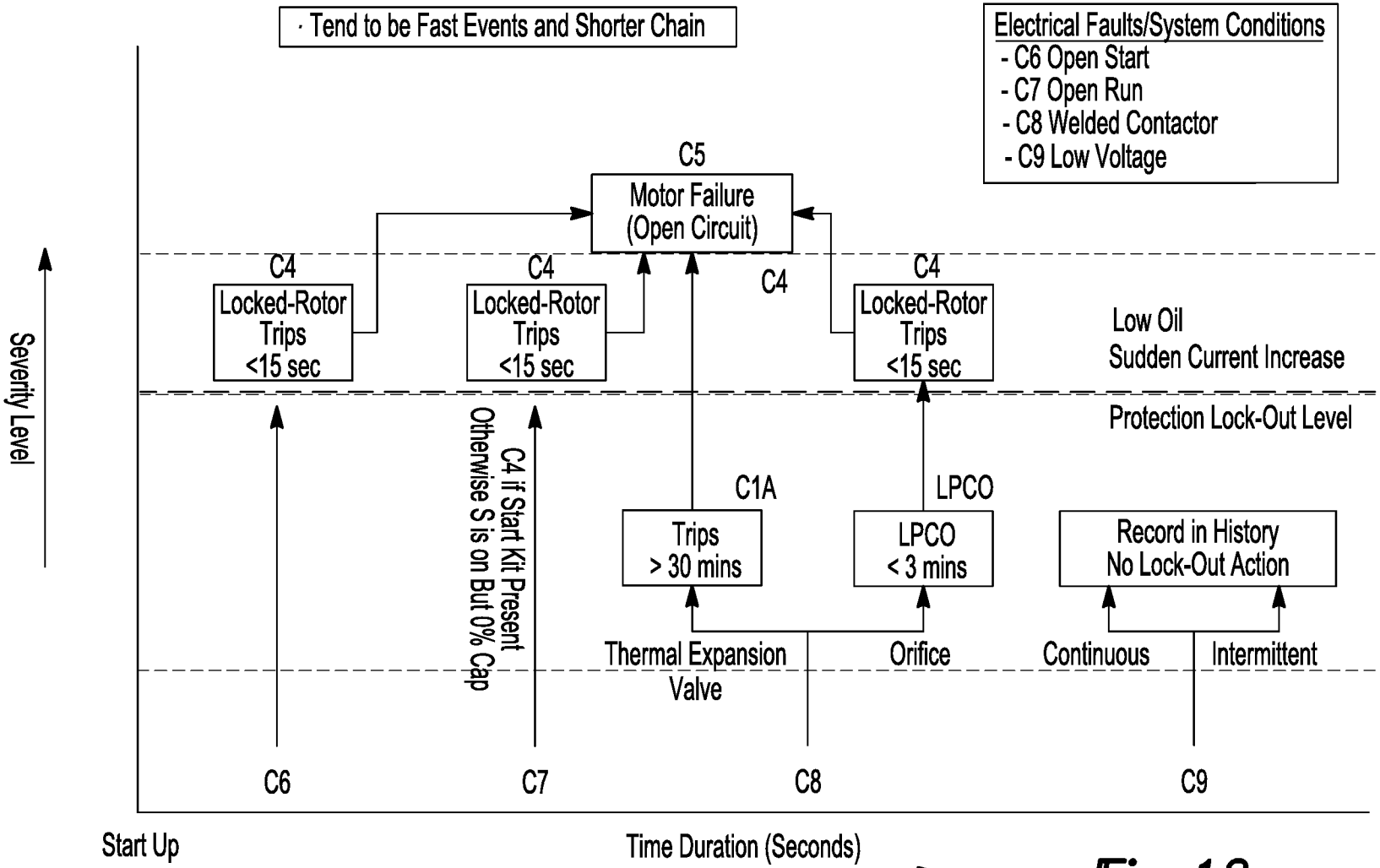

FIG. 4*a* is a schematic representation of a controller in accordance with the principles of the present disclosure for use with a compressor and/or a refrigeration system;

FIG. 4*b* is a schematic representation of a controller in accordance with the principles of the present disclosure for use with a compressor and/or a refrigeration system;

FIG. 5 is a flow chart detailing operation of a diagnostic system in accordance with the principles of the present disclosure;

FIG. 6 is a graph illustrating compressor ON time and compressor OFF time for use in differentiating between a low-side fault and a high-side fault;

FIG. 7 is a chart providing diagnostic rules for use in differentiating between a low-side fault and a high-side fault;

FIG. 8 is a flow chart for use in differentiating between cycling of a motor protector and cycling of either a low-pressure cutout switch or a high-pressure cutout switch;

FIG. 9 is a graph of relative compressor current rise over time for use in differentiating between low-side faults and high-side faults;

FIG. 10 is a graph of severity level verses time for low-side fault conditions;

FIG. 11 is a graph of severity level verses time for high-side fault conditions; and FIG. 12 is a graph of severity level verses time for electrical faults.

DETAILED DESCRIPTION

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated or group) and memory that execute one or more software or firmware programs, a combinational logic circuit, or other suitable components that provide the described functionality.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
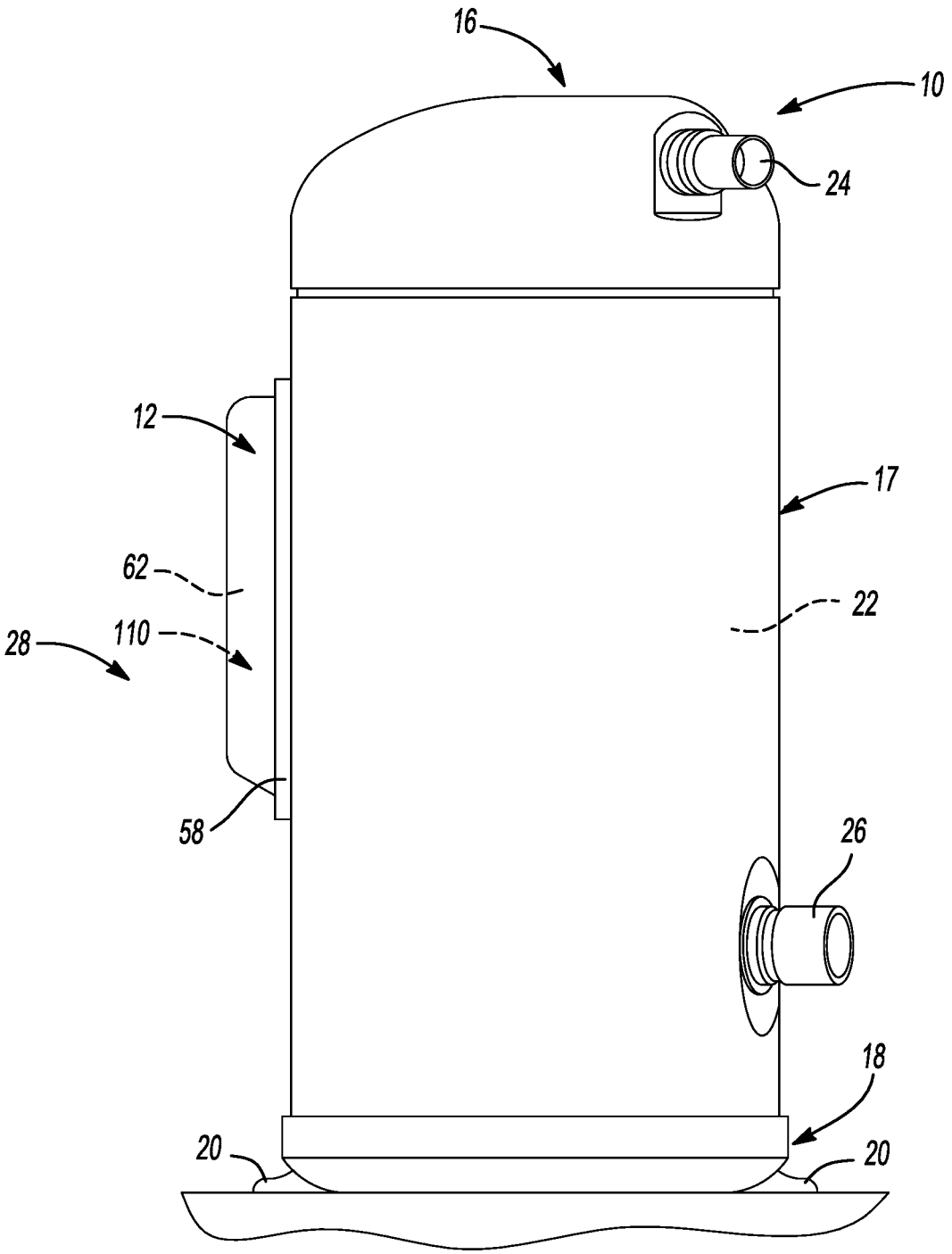
FIG. 1 is a perspective view of a compressor in accordance with the principles of the present teachings.
Figure 2:
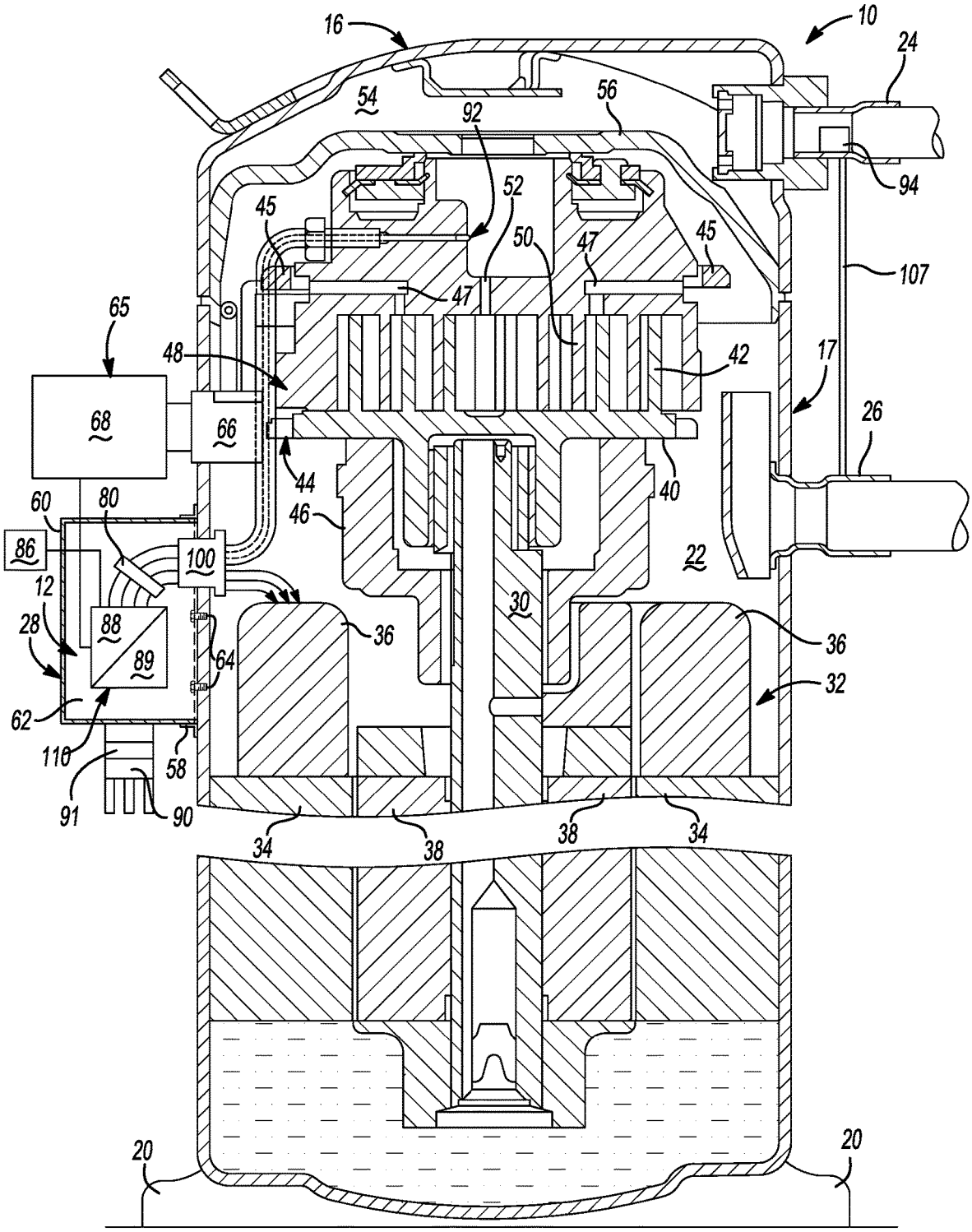
FIG. 2 is a cross-sectional view of the compressor of FIG. 1.

With reference to the drawings, a compressor 10 is shown incorporating a diagnostic and control system 12. The compressor 10 is shown to include a generally cylindrical hermetic shell 17 having a welded cap 16 at a top portion and a base 18 having a plurality of feet 20 welded at a bottom portion. The cap 16 and the base 18 are fitted to the shell 17 such that an interior volume 22 of the compressor 10 is defined. The cap 16 is provided with a discharge fitting 24, while the shell 17 is similarly provided with an inlet fitting 26, disposed generally between the cap 16 and base 18, as best shown in FIG. 2. In addition, an electrical enclosure 28 may be fixedly attached to the shell 17 generally between the cap 16 and the base 18 and may support a portion of the diagnostic and control system 12 therein.

A crankshaft 30 is rotatably driven by an electric motor 32 relative to the shell 17. The motor 32 includes a stator 34 fixedly supported by the hermetic shell 17, windings 36 passing therethrough, and a rotor 38 press-fit on the crankshaft 30. The motor 32 and associated stator 34, windings 36, and rotor 38 cooperate to drive the crankshaft 30 relative to the shell 17 to compress a fluid.

The compressor 10 further includes an orbiting scroll member 40 having a spiral vane or wrap 42 on an upper surface thereof for use in receiving and compressing a fluid. An Oldham coupling 44 is disposed generally between the orbiting scroll member 40 and bearing housing 46 and is keyed to the orbiting scroll member 40 and a non-orbiting scroll member 48. The Oldham coupling 44 transmits rotational forces from the crankshaft 30 to the orbiting scroll member 40 to compress a fluid disposed generally between the orbiting scroll member 40 and the non-orbiting scroll member 48. Oldham coupling 44, and its interaction with orbiting scroll member 40 and non-orbiting scroll member 48, is preferably of the type disclosed in assignee's commonly owned U.S. Pat. No. 5,320,506, the disclosure of which is incorporated herein by reference.

Non-orbiting scroll member 48 also includes a wrap 50 positioned in meshing engagement with the wrap 42 of the orbiting scroll member 40. Non-orbiting scroll member 48 has a centrally disposed discharge passage 52, which communicates with an upwardly open recess 54. Recess 54 is in fluid communication with the discharge fitting 24 defined by the cap 16 and a partition 56, such that compressed fluid exits the shell 17 via discharge passage 52, recess 54, and discharge fitting 24. Non-orbiting scroll member 48 is designed to be mounted to bearing housing 46 in a suitable manner such as disclosed in assignee's commonly owned U.S. Pat. Nos. 4,877,382 and 5,102,316, the disclosures of which are incorporated herein by reference.

The electrical enclosure 28 may include a lower housing 58, an upper housing 60, and a cavity 62. The lower housing 58 may be mounted to the shell 17 using a plurality of studs 64, which may be welded or otherwise fixedly attached to the shell 17. The upper housing 60 may be matingly received by the lower housing 58 and may define the cavity 62 therebetween. The cavity 62 is positioned on the shell 17 of the compressor 10 and may be used to house respective components of the diagnostic and control system 12 and/or other hardware used to control operation of the compressor 10 and/or refrigeration system 11.

With particular reference to FIG. 2, the compressor 10 is shown to include an actuation assembly 65 that selectively modulates a capacity of the compressor 10. The actuation assembly 65 may include a solenoid 66 connected to the orbiting scroll member 40 and a controller 68 coupled to the solenoid 66 for controlling movement of the solenoid 66 between an extended position and a retracted position.

Movement of the solenoid 66 into the extended position rotates a ring valve 45 surrounding the non-orbiting scroll member 48 to bypass suction gas through at least one passage 47 formed in the non-orbiting scroll member 48 to reduce an output of the compressor 10. Conversely, movement of the solenoid 66 into the retracted position moves the ring valve 45 to close the passage 47 to increase a capacity of the compressor 10 and allow the compressor 10 to operate at full capacity. In this manner, the capacity of the compressor 10 may be modulated in accordance with demand or in response to a fault condition. Actuation assembly 65 may be used to modulate the capacity of compressor 10 such as disclosed in assignee's commonly owned U.S. Pat. No. 5,678,985, the disclosure of which is incorporated herein by reference.

Figure 3:
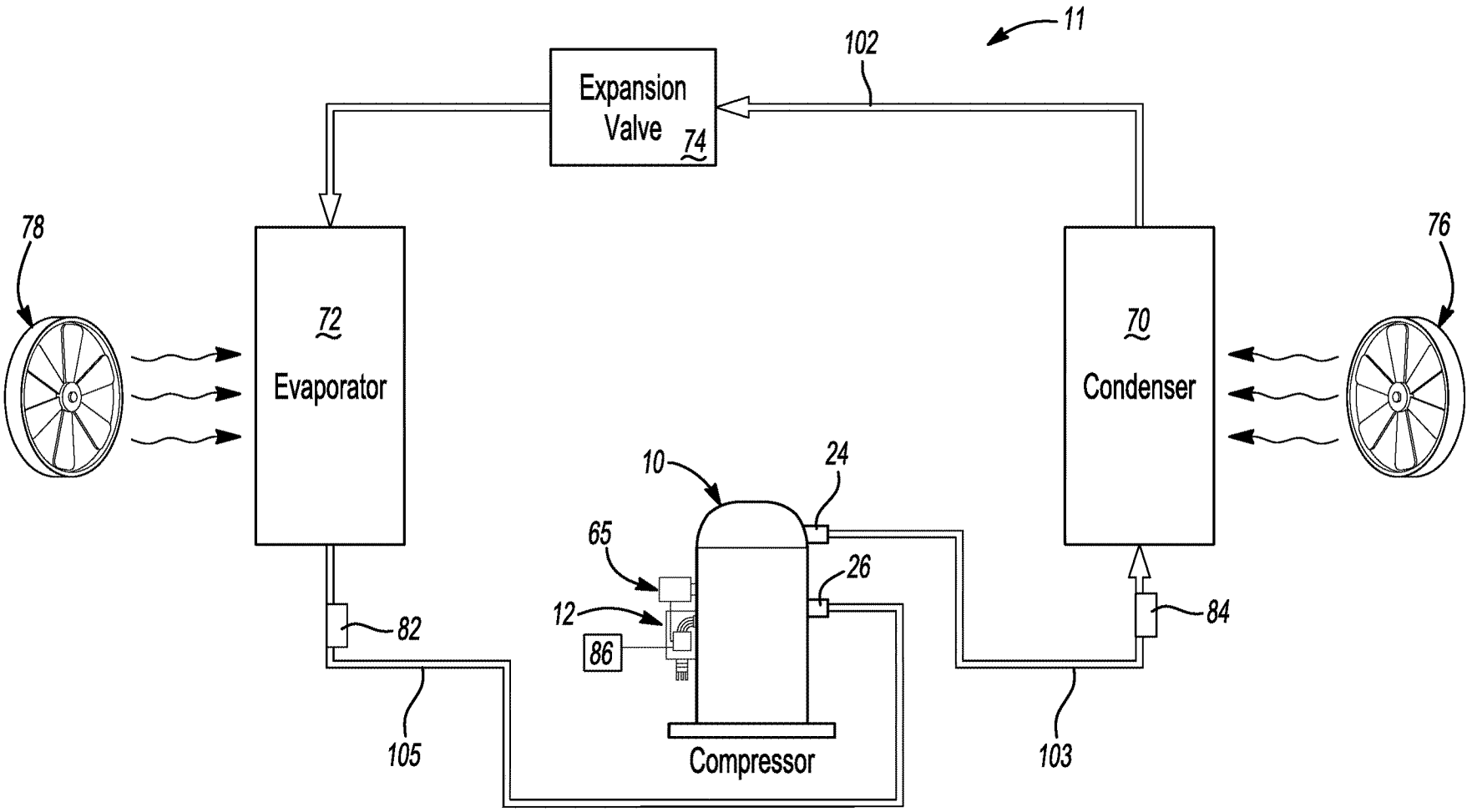
FIG. 3 is a schematic representation of a refrigeration system incorporating the compressor of FIG. 1.

With particular reference to FIG. 3, the refrigeration system 11 is shown as including a condenser 70, an evaporator 72, and an expansion device 74 disposed generally between the condenser 70 and the evaporator 72. The refrigeration system 11 also includes a condenser fan 76 associated with the condenser 70 and an evaporator fan 78 associated with the evaporator 72. Each of the condenser fan 76 and the evaporator fan 78 may be variable-speed fans that can be controlled based on a cooling and/or heating demand of the refrigeration system 11. Furthermore, each of the condenser fan 76 and evaporator fan 78 may be controlled by the diagnostic and control system 12 such that operation of the condenser fan 76 and evaporator fan 78 may be coordinated with operation of the compressor 10.

In operation, the compressor 10 circulates refrigerant generally between the condenser 70 and evaporator 72 to produce a desired heating and/or cooling effect. The compressor 10 receives vapor refrigerant from the evaporator 72 generally at the inlet fitting 26 and compresses the vapor refrigerant between the orbiting scroll member 40 and the non-orbiting scroll member 48 to deliver vapor refrigerant at discharge pressure at discharge fitting 24.

Once the compressor 10 has sufficiently compressed the vapor refrigerant to discharge pressure, the discharge-pressure refrigerant exits the compressor 10 at the discharge fitting 24 and travels within the refrigeration system 11 to the condenser 70. Once the vapor enters the condenser 70, the refrigerant changes phase from a vapor to a liquid, thereby rejecting heat. The rejected heat is removed from the condenser 70 through circulation of air through the condenser 70 by the condenser fan 76. When the refrigerant has sufficiently changed phase from a vapor to a liquid, the refrigerant exits the condenser 70 and travels within the refrigeration system 11 generally towards the expansion device 74 and evaporator 72.

Upon exiting the condenser 70, the refrigerant first encounters the expansion device 74. Once the expansion device 74 has sufficiently expanded the liquid refrigerant, the liquid refrigerant enters the evaporator 72 to change phase from a liquid to a vapor. Once disposed within the evaporator 72, the liquid refrigerant absorbs heat, thereby changing from a liquid to a vapor and producing a cooling effect. If the evaporator 72 is disposed within an interior of a building, the desired cooling effect is circulated into the building to cool the building by the evaporator fan 78. If the evaporator 72 is associated with a heat-pump refrigeration system, the evaporator 72 may be located remote from the building such that the cooling effect is lost to the atmosphere and the rejected heat experienced by the condenser 70 is directed to the interior of the building to heat the building. In either configuration, once the refrigerant has sufficiently changed phase from a liquid to a vapor, the vaporized refrigerant is received by the inlet fitting 26 of the compressor 10 to begin the cycle anew.

With continued reference to FIGS. 2, 3, 4*a*, and 4*b*, the compressor 10 and refrigeration system 11 are shown incorporating the diagnostic and control system 12. The diagnostic and control system 12 may include a current sensor 80, a low-pressure cutout switch 82 disposed on a conduit 105 of the refrigeration system 11, a high-pressure cutout switch 84 disposed on a conduit 103 of the refrigeration system 11, and an outdoor/ambient temperature sensor 86. The diagnostic and control system 12 may also include processing circuitry 88, a memory 89, and a compressor-contactor control or power-interruption system 90.

The processing circuitry 88, memory 89, and power-interruption system 90 may be disposed within the electrical enclosure 28 mounted to the shell 17 of the compressor 10 (FIG. 2). The sensors 80, 86 cooperate to provide the processing circuitry 88 with sensor data indicative of compressor and/or refrigeration system operating parameters for use by the processing circuitry 88 in determining operating parameters of the compressor 10 and/or refrigeration system 11. The switches 82, 84 are responsive to system pressure and cycle between an open state and a closed state in response to low-system pressure (switch 82) or high-system pressure (switch 84) to protect the compressor 10 and/or components of the refrigeration system 11 should either a low-pressure condition or a high-pressure condition be detected.

The current sensor 80 may provide diagnostics related to high-side conditions or faults such as compressor mechanical faults, motor faults, and electrical component faults such as missing phase, reverse phase, motor winding current imbalance, open circuit, low voltage, locked rotor current, excessive motor winding temperature, welded or open contactors, and short cycling. The current sensor 80 may monitor compressor current and voltage for use in determining and differentiating between mechanical faults, motor faults, and electrical component faults, as will be described further below. The current sensor 80 may be any suitable current sensor such as, for example, a current transformer, a current shunt, or a hall-effect sensor.

The current sensor 80 may be mounted within the electrical enclosure 28 (FIG. 2) or may alternatively be incorporated inside the shell 17 of the compressor 10. In either case, the current sensor 80 may monitor current drawn by the compressor 10 and may generate a signal indicative thereof, such as disclosed in assignee's commonly owned U.S. Pat. No. 6,758,050, U.S. Pat. No. 7,290,989, and U.S. Pat. No. 7,412,842, the disclosures of which are incorporated herein by reference.

The diagnostic and control system 12 may also include an internal discharge-temperature switch 92 mounted in a discharge-pressure zone and/or an internal high-pressure relief valve 94 (FIG. 2). The internal discharge-temperature switch 92 may be disposed proximate to the discharge fitting 24 or the discharge passage 52 of the compressor 10. The discharge-temperature switch 92 may be responsive to elevations in discharge temperature and may open based on a predetermined temperature. While the discharge-temperature switch 92 is described as being "internal," the discharge-temperature switch 92 may alternatively be disposed external from the compressor shell 17 and proximate to the discharge fitting 24 such that vapor at discharge pressure encounters the discharge-temperature switch 92. Locating the discharge-temperature switch 92 external of the shell 17 allows flexibility in compressor and system design by providing discharge-temperature switch 92 with the ability to be readily adapted for use with practically any compressor and any system.

Regardless of the location of the discharge-temperature switch 92, when a predetermined temperature is achieved, the discharge-temperature switch 92 may respond by opening and bypassing discharge-pressure gas to a low-side (i.e., suction side) of the compressor 10 via a conduit 107 (FIG. 2) extending between the discharge fitting 24 and the inlet fitting 26. In so doing, the temperature in a high-side (i.e., discharge side) of the compressor 10 is reduced and is therefore maintained at or below the predetermined temperature.

The internal high-pressure relief valve 94 is responsive to elevations in discharge pressure to prevent discharge pressure within the compressor 10 from exceeding a predetermined pressure. In one configuration, the high-pressure relief valve 94 compares discharge pressure within the compressor 10 to suction pressure within the compressor 10. If the detected discharge pressure exceeds suction pressure by a predetermined amount, the high-pressure relief valve 94 opens causing discharge-pressure gas to bypass to the low-side or suction-pressure side of the compressor 10 via conduit 107. Bypassing discharge-pressure gas to the suction-side of the compressor 10 prevents the pressure within the discharge-pressure side of the compressor 10 from further increasing.

Any or all of the foregoing switches/valves (92, 94) may be used in conjunction with any of the current sensor 80, low-pressure cutout switch 82, high-pressure cutout switch 84, and outdoor/ambient temperature sensor 86 to provide the diagnostic and control system 12 with additional compressor and/or refrigeration system information or protection. While the discharge-temperature switch 92 and the high-pressure relief valve 94 could be used in conjunction with the low-pressure cutout switch 82 and the high-pressure cutout switch 84, the discharge-temperature switch 92 and the high-pressure relief valve 94 may also be used with compressors/systems that do not employ a low-pressure cutout switch 82 or a high-pressure cutout switch 84.

A hermetic terminal assembly 100 may be used with any of the foregoing switches, valves, and sensors to maintain the sealed nature of the compressor shell 17 to the extent any of the switches, valves, and sensors are disposed within the compressor shell 17 and are in communication with the processing circuitry 88 and/or memory 89. In addition, multiple hermetic terminal assemblies 100 may be used to provide sealed electrical communication through the compressor shell 17 for the various electrical requirements.

The outdoor/ambient temperature sensor 86 may be located external from the compressor shell 17 and generally provides an indication of the outdoor/ambient temperature surrounding the compressor 10 and/or refrigeration system 11. The outdoor/ambient temperature sensor 86 may be positioned adjacent to the compressor shell 17 such that the outdoor/ambient temperature sensor 86 is in close proximity to the processing circuitry 88 (FIGS. 2 and 3). Placing the outdoor/ambient temperature sensor 86 in close proximity to the compressor shell 17 provides the processing circuitry 88 with a measure of the temperature generally adjacent to the compressor 10. Locating the outdoor/ambient temperature sensor 86 in close proximity to the compressor shell 17 not only provides the processing circuitry 88 with an accurate measure of the air temperature around the compressor 10, but also allows the outdoor/ambient temperature sensor 86 to be attached to or disposed within the electrical enclosure 28.

The power interruption system 90 may similarly be located proximate to or within the electrical enclosure 28 and may include a motor protector 91 movable between an open or "tripped" state restricting power to the electric motor 32 and a closed state permitting power to the electric motor 32. The motor protector 91 may be a thermally responsive device that opens in response to a predetermined current drawn by the electric motor 32 and/or to a temperature within the compressor shell 17 or of an electric conductor supplying power to the electric motor 32. While the motor protector 91 is shown as being disposed in proximity to the electrical enclosure 28 and externally to the compressor shell 17, the motor protector 91 could alternatively be disposed within the compressor shell 17 and in close proximity to the electric motor 32.

With particular reference to FIG. 4*a*, a controller 110 for use with the diagnostic and control system 12 is provided. The controller 110 may include processing circuitry 88 and/or memory 89 and may be disposed within the electrical enclosure 28 of the compressor 10. The controller 110 may include an input in communication with the current sensor 80 as well as an input that receives a thermostat-demand signal (Y) from a thermostat 83. The low-pressure cutout switch 82 and high-pressure cutout switch 84 may be wired directly to the controller 110 such that the switches 82, 84 are in series with a contactor 85 of the compressor 10. Wiring the low-pressure cutout switch 82 and high-pressure cutout switch 84 directly to the controller 110 in this fashion allows for differentiation between pressure-switch cutouts (i.e., cutouts caused by the low-pressure cutout switch 82 and/or high-pressure cutout switch 84) and motor-protector trips without affecting thermostat demand (Y). While the low-pressure cutout switch 82 and high-pressure cutout switch 84 are described and shown as being wired directly to the controller 110, the low-pressure cutout switch 82 and high-pressure cutout switch 84 could alternatively be wired in series with the thermostat-demand signal (Y) (FIG. 4*b*).

The memory 89 may record historical fault data as well as asset data such as compressor model and serial number. The controller 110 may also be in communication with the compressor-contactor control 90 as well as with a communication port 116. The communication port 116 may be in communication with a series of light emitting devices (LED) 118 (FIGS. 4*a* and 4*b*) to identify a status of the compressor 10 and/or refrigeration system 11. The communication port 116 may also be in communication with a viewing tool 120 such as, for example, a desktop computer, laptop computer, or hand-held device to visually indicate a status of the compressor 10 and/or refrigeration system 11.

With particular reference to FIG. 5, a flow chart detailing operation of a predictive diagnostic system 122 in accordance with the principles of the present disclosure is illustrated. The predictive diagnostic system 122 may be stored within the memory 89 of the controller 110 to allow the controller 110 to execute the steps of the predictive diagnostic system 122 in diagnosing the compressor 10 and/or refrigeration system 11. The predictive diagnostic system 122 may observe and predict fault trends (FIGS. 10 and 11) to timely protect the compressor 10 and/or refrigeration system 11.

The predictive diagnostic system 122 determines fault alerts at 124 and monitors a chain of faults to predict the severity of a system or fault condition at 126. If the controller 110 determines that the fault chain is not severe at 127, the controller 110 may blink an amber LED 118 to signify to a service person that the fault history for the compressor 10 and/or refrigeration system 11 is in a non-severe condition at 128. If the controller 110 determines that the fault chain is severe at 127, and simultaneously determines that protection of the compressor 10 is not required at 129, the controller 110 may blink red LEDs 118 to indicate to a service person that protection of the compressor 10 is not required but that the compressor 10 is experiencing a severe condition at 130. If the controller 110 determines a severe condition at 127 and that protection of the compressor 10 is required at 129, the controller 110 illuminates a solid red LED 118 to indicate a protection condition at 132. Indicating the protection condition at 132 signifies that protection of the compressor 10 is required and that a service call is needed to repair the protection condition 132.

When protection of the compressor 10 is required, the controller 110 may shut down the compressor 10 at 133 via the power-interruption system 90 to prevent damage to the compressor 10 and may report the condition to the viewing tool 120 at 135. The controller 110 may prevent further operation of the compressor 10 until the compressor 10 is repaired at 137 and the condition or fault remedied. Once the condition or fault is remedied at 137, operation of the compressor 10 is once again permitted and the controller 110 continues to monitor operation thereof.

The controller 110 may differentiate between a low-side condition or fault and a high-side condition or fault based on information received from the current sensor 80. Low-side faults may include a low-charge condition, a low evaporator air flow condition, and a stuck control valve condition. High-side faults may include a high-charge condition, a low condenser air-flow condition, and a non-condensibles condition. The controller 110 may differentiate between the low-side faults and the high-side faults by monitoring the current drawn by the electric motor 32 of the compressor 10 over time and by tracking various events during operation of the compressor 10.

The controller 110 may monitor and record into the memory 89 various events that occur during operation of the compressor 10 to both distinguish between low-side conditions or faults and high-side conditions or faults as well as to identify the specific low-side fault or high-side fault experienced by the compressor 10. For low-side fault conditions, the controller 110 may monitor and record into the memory 89 low-side events such as a long-run-time condition (C1), a motor-protector-trip condition with a long-run time (C1A), and cycling of the low-pressure cutout switch 82 (LPCO). For high-side faults, the controller 110 may monitor and record into the memory 89 high-side events such as a high-current-rise condition (CR), a motor-protector-trip condition with a short-run time (C2), and cycling of the high-pressure cutout switch 84 (HPCO).

Based on the at least one of the types of events, frequency of events, combination of events, sequence of events, and the total elapsed time for these events, the controller 110 is able to predict the severity level of the system condition or fault affecting operation of the compressor 10 and/or refrigeration system 11. By predicting the severity of the fault or system condition, the controller 110 is able to determine when to engage the power-interruption system 90 and restrict power to the compressor 10 to prevent operation of the compressor 10 when conditions are unfavorable. Such predictive capabilities also allow the controller 110 to validate the fault or system condition and only restrict power to the compressor 10 when necessary.

The controller 110 can initially determine whether a fault condition experienced by the compressor 10 is the cause of a low-side condition or a high-side condition by monitoring a current drawn by the electric motor 32 of the compressor 10. The controller 110 can also determine whether the low-side fault or high-side fault is a result of cycling of either the low-pressure cutout switch 82 or high-pressure cutout switch 84 by monitoring the current drawn by the electric motor 32 of the compressor 10.

With reference to FIG. 6, the controller 110 may determine whether either of the low-pressure cutout switch 82 or high-pressure cutout switch 84 is cycling by monitoring the compressor ON time and the compressor OFF time. For example, if compressor ON time is less than approximately three (3) minutes, compressor OFF time is less than approximately five (5) minutes, and such cycling is recorded into the memory 89 for three consecutive cycles (i.e., thee consecutive cycles of compressor ON time being less than three minutes and compressor OFF time being less than five minutes), the controller 110 can determine that one of the low-pressure cutout switch 82 and the high-pressure 84 is cycling.

The controller 110 can determine that one of the low-pressure cutout switch 82 and high-pressure switch is cycling based on the foregoing compressor ON time and compressor OFF time, as the low-pressure cutout switch 82 and high-pressure cutout switch 84 generally cycle faster between an open state and a closed state when compared to cycling of the motor protector 91 between an open state (i.e., a "tripped" state) and a closed state. As such, the controller 110 can not only identify whether the low-pressure cutout switch 82 or high-pressure switch 84 is cycling but also can determine whether the motor protector 91 is cycling based on the compressor ON time and the compressor OFF time. Furthermore, the controller 110 can also rely on the thermostat-demand signal (Y) in diagnosing the compressor 10 and/or refrigeration system 11, as the above system faults usually result in a low-capacity condition, thereby preventing the system 11 from satisfying the thermostat 83 and, thus, the thermostat-demand signal (Y) typically remains ON.

The motor protector 91 generally requires a longer time to reset than does the low-pressure cutout switch 82 and the high-pressure switch 84, as set forth above. Therefore, the controller 110 can differentiate between cycling of either of the low-pressure cutout switch 82 and the high-pressure cutout switch 84 and cycling of the motor protector 91 by monitoring the compressor ON time and the compressor OFF time. For example, if the maximum OFF time of the compressor 10 is less than approximately seven (7) minutes, the controller 110 can determine that one of the low-pressure cutout switch 82 and the high-pressure cutout switch 84 is cycling. Conversely, if the OFF time of the compressor 10 is determined to be greater than seven (7) minutes, the controller 110 can determine that the motor protector 91 is cycling.

While the controller 110 can differentiate between cycling of the motor protector 91 and the switches 82, 84, the controller 110 cannot determine—by compressor ON/OFF time alone—which of the low-pressure cutout switch 82 and high-pressure cutout switch 84 is cycling, as the low-pressure cutout switch 82 and high-pressure cutout switch 84 are wired in series and each of the low-pressure cutout switch 82 and high-pressure switch 84 has a similar reset time and therefore cycles at approximately the same rate. The controller 110 can differentiate between cycling of the low-pressure cutout switch 82 and cycling of the high-pressure cutout switch 84 by first determining whether the compressor 10 is experiencing a low-side fault or a high-side fault by monitoring the current draw of the electric motor 32. Specifically, the controller 110 can compare the current drawn by the electric motor 32 (i.e., the "running current") to a baseline current value to differentiate between a low-side fault and a high-side fault.

The controller 110 can store a baseline current signature for the compressor 10 taken during a predetermined time period following startup of the compressor 10 for comparison to a running current of the compressor 10. In one configuration, the controller 110 records into the memory 89 the current drawn by the electric motor 32 for approximately the first seven (7) seconds of operation of the compressor 10 following startup. During operation of the compressor 10, the running current of the compressor 10 is monitored and recorded into the memory 89 and can be compared to the stored baseline current signature to determine whether the compressor 10 is experiencing a low-side fault or a high-side fault. The controller 110 can therefore continuously monitor the running current of the compressor 10 and can continuously compare the running current of the compressor 10 to the baseline current signature of the compressor 10.

For example, the controller 110 can monitor the current drawn by the compressor motor 32 for the first three (3) minutes of compressor ON time and can determine a ratio of the current drawn over the first three (3) minutes of compressor ON time over the baseline current value. In one configuration, if this ratio exceeds approximately 1.4, the controller 110 can declare that the compressor 10 is experiencing a high-side fault condition (FIGS. 7 and 8).

As shown in FIG. 6, the controller 110 can determine that the fault experienced by the compressor 10 is due to cycling of the low-pressure cutout switch 82 or the cycling of the high-pressure cutout switch 84 if the OFF time of the compressor 10 is less than approximately seven (7) minutes and can determine that the fault experienced by the compressor 10 is due to cycling of the motor protector 91 if the OFF time of the compressor 10 exceeds approximately seven (7) minutes. The controller 110 can also differentiate between a low-side fault condition and a high-side fault condition by comparing the running current to a baseline current to determine whether the fault affecting the compressor 10 is a low-side fault or a high-side fault. As such, the controller 110 can pinpoint the particular device that is cycling (i.e., the low-pressure cutout switch 82, the high-pressure cutout switch 84, or the motor protector 91) by monitoring the current drawn by the electric motor 32 over time.

If the refrigeration system 11 does not include a low-pressure cutout switch 82 or a high-pressure cutout switch 84, the controller 110 can determine opening of the discharge-temperature switch 92 or the internal high-pressure relief valve 94 to differentiate between a low-side fault and a high-side fault. For example, when the internal high-pressure relief valve 94 is open, and discharge-pressure gas is bypassed to the suction-side of the compressor 10, the current sensor 80 will identify a roughly thirty (30) percent decrease in current drawn by the electric motor 32 along with a motor-protector trip condition approximately fifteen (15) minutes following opening of the internal high-pressure relief valve 94. As such, the controller 110 can determine a high-pressure fault without requiring a high-pressure cutout switch 84. A low-side fault can similarly be determined when the discharge-temperature switch 92 is opened by monitoring current draw via current sensor 80.

With reference to FIG. 7, the controller 110 can differentiate between various low-side faults and various high-side faults by not only comparing the initial current signature of the compressor 10 as well as cycling of any of the low-pressure cutout switch 82, high-pressure cutout switch 84 and motor protector 91, but can also differentiate between various low-side faults and various high-side faults by combining the current signature and cycling information with particular ranges for compressor ON time and compressor OFF time. FIG. 8 further illustrates the foregoing principles by providing a flow chart for use by the controller 110 in differentiating not only between a low-side fault and a high-side fault but also between cycling of the low-pressure cutout switch 82, high-pressure cutout switch 84, and motor protector 91.

With particular reference to FIG. 9, a graph of relative compressor current rise verses time is provided. As shown in FIG. 9, if the relative compressor current rise (i.e., the ratio of the run current to the baseline current) is greater than approximately 1.4 or 1.5, the controller 110 can determine that the compressor 10 is experiencing a high-side fault condition. Once the controller 110 determines that the compressor 10 is experiencing a high-side fault condition, the controller 110 can then differentiate between various types of high-side fault events. Similarly, if the compressor current rise is less than approximately 1.1, the controller 110 can determine that the compressor 10 is experiencing a low-side fault condition.

In addition to differentiating between low-side faults and high-side faults, the controller 110 also monitors and records into the memory 89 fault events occurring over time. For example, the controller 110 monitors and stores in the memory 89 the fault history of the compressor 10 to allow the controller 110 to predict a severity of the fault experienced by the compressor 10.

With particular reference to FIG. 10, a chart outlining various low-side faults or low-side system conditions such as, for example, a low-charge condition, a low-evaporator-air-flow condition, and a stuck-orifice condition, is provided. The low-side faults/conditions may include various fault events, such as, for example, a long cycle run time event (C1), a motor protector trip cycling event (CIA), and a low-pressure switch short cycling event (LPCO). The various low-side fault events may be the result of various conditions experienced by the compressor 10 and/or refrigeration system 11.

The compressor 10 may experience a long cycle run time event (C1) if the compressor 10 and/or refrigeration system 11 experiences a gradual slow leak of refrigerant (i.e., a 70% charge level at 95 degrees Fahrenheit). The compressor 10 may also experience a long cycle run time event (C1) due to a loss in capacity caused by a lower evaporator temperature, which may be exacerbated at high condenser temperatures. Detecting a relative long compressor run time (i.e., greater than approximately 14 hours) provides an early indication of a low-side fault.

The controller 110 may declare a cycling of the motor protector 91 (C1A) when the compressor 10 runs for a predetermined time at a lower evaporator temperature, a higher condenser temperature, and a higher superheat. Such conditions may cause the motor protector 91 to trip due to overheating of the motor 32 or due to tripping of the discharge-temperature switch 92. The foregoing conditions may occur at a reduced-charge level (i.e., 30% charge level) and may provide an indication of a low-side fault when compressor ON time is between approximately fifteen (15) and thirty (30) minutes.

As described above, the compressor 10 may include a discharge-temperature switch 92. The controller 110 can identify if the internal discharge-temperature switch 92 bypasses the discharge-pressure gas to the low-side of the compressor 10 via conduit 107 by concurrently detecting a roughly thirty (30) percent sudden decrease in current drawn by the electric motor 32 followed by a trip of the motor protector 91. The motor protector 91 trips following bypass of the discharge-pressure gas into the low-side of the compressor 10 due to the sudden increase in temperature within the compressor 10 proximate to the electric motor 32.

If the refrigeration system 11 includes a low-pressure temperature switch 82, the controller 110 can identify cycling of the low-pressure cutout switch 82. Specifically, if the controller 110 can rule out a sudden increase in current drawn by the electric motor 32 (i.e., if the relative compressor current rise is not greater than 1.4) in combination with the compressor ON time being less than approximately three (3) minutes and the compressor OFF time being less than approximately seven (7) minutes, the controller 110 can determine cycling of the low-pressure cutout switch 82.

With continued reference to FIG. 10, the controller 110 can plot the low-side fault events (i.e., long cycle run time (C1), motor protector trip cycles (C1A), low-pressure switch short cycling (LPCO)) on a plot of severity level of the fault over time. As shown in FIG. 10, the controller may identify a long cycle run time event (C1) if the compressor 10 continuously runs for approximately 14 or more hours. Likewise, as set forth above, the controller 110 will identify cycling of the low-pressure cutout switch 82 if the compressor ON time is less than approximately three (3) minutes and the compressor OFF time is less than approximately seven (7) minutes and will identify and store a motor protector trip cycle event if the compressor ON time is less than approximately thirty (30) minutes and the compressor OFF time is greater than approximately seven (7) minutes. The controller 110 will continue to monitor the foregoing events and plot the events over time.

The controller 110 may continuously monitor at least one of the type of event, the number of occurrences of the particular event, as well as the sequence of the events. Based on at least one of the type of event, the number of events, and the sequence of the events, the controller 110 can determine whether to lock out and prevent operation of the compressor 10 via the power-interruption system 90. For example, the following table provides one example as to a set of criteria by which the controller 110 may lock out operation of the compressor 10 if the compressor 10 is experiencing a low-side fault/low-side system condition.

TABLE 1

| Low-Side Fault Events Combination | No. of Events | Severity Level for Protection |
|---|---|---|
| C1 | 1 | no action |
| C1A | 1 | lock out if C1A > 15x within 2 days |
| LPCO | 1 | lock out if LPCO > 30x per day |
| C1 + C1A | 2 | lock out if C1A > 15x within 2 days |
| C1 + LPCO | 2 | lock out if LPCO > 3x consecutive |
| LPCO + C1A | 2 | lock out if C1A > 7x within 2 days |
| C1 + LPCO + C1A | 3 | lock out if C1A > 7x within 2 days |

As set forth in Table 1 the controller 110 will lock out the compressor 10, for example, if a long cycle run time event (C1) is determined in combination with fifteen (15) or more motor protector trip cycles (C1A) within two (2) days. In addition, the controller 110 will lock out the operation of the compressor 10 via the power-interruption system 90 if a low pressure cutout switch short cycling condition (LPCO) is realized in conjunction with motor protector trip cycles (C1A) exceeding seven (7) within two (2) days time. Based on the foregoing, the controller 110 relies on both of the type of low-side fault event, the number of low-side events, as well as the number of low-side events detected over a predetermined time period. Various other conditions (i.e., pattern of single low-side-fault events or combination of low-side-fault events) may cause the controller 110 to lock out the compressor 10, as shown in Table 1 above.

In addition to monitoring the low-side fault events shown in FIG. 10, the controller 110 will immediately shut down the compressor 10 via the power-interruption system 90 should a locked-rotor condition (C4) be detected.

Specifically, the controller 110 will restrict power to the motor 32 of the compressor 10 within approximately fifteen (15) seconds of detecting a locked-rotor condition to prevent damage to the compressor 10. While a locked-rotor condition should be predicted based on monitoring the low-side fault events shown in FIG. 10, should a locked-rotor condition (C4) be detected without being predicted by the low-side fault events of FIG. 10, the controller 110 will nonetheless lock out the compressor 10 via the power-interruption system 90 to prevent damage to the compressor 10.

With particular reference to FIG. 11, a chart outlining various high-side faults or high-side system conditions such as, for example, a high-charge condition, a low-condenser-air-flow condition, and a non-condensables condition, is provided. The high-side faults/conditions may include various fault events such as, for example, cycling of the high-pressure cutout switch 84 (HPCO), long cycling of the motor protector 91 (C1A), and short cycling of the motor protector (C2).

Cycling of the high-pressure cutout switch 84 (HPCO) serves as an early high-side-fault indicator and may be determined when compressor ON time is less than approximately three (3) minutes and compressor OFF time is less than approximately three (3) minutes. In another configuration, cycling of the high-pressure cutout switch 84 (HPCO) may be determined when compressor ON time is less than approximately three (3) minutes and compressor OFF time is less than approximately seven (7) minutes (FIG. 8).

Long cycling of the motor protector 91 (C1A) may be determined when compressor ON time is between approximately fifteen (15) and thirty (30) minutes and is a more severe high-side fault than cycling of the high-pressure cutout switch 84 (HPCO). Short cycling of the motor protector 91 (C2) is an even more severe high-side fault than long cycling of the motor protector 91 (C1A) and may be determined when compressor ON time is between approximately one (1) and fifteen (15) minutes.

Long cycling of the motor protector 91 (C1A) and short cycling of the motor protector 91 (C2) may be caused by a relatively long compressor ON time in combination with a higher condenser temperature (Tcond) and higher superheat or a low evaporator temperature (Tevap). The foregoing conditions may cause the motor protector 91 to trip (CIA) and/or short cycling of the motor protector (C2) due to excessive current drawn by the motor 32 or may cause the pressure-relief valve 94 to open.

The controller 110 can determine cycling of the high-pressure cutout switch (84) by first determining that the compressor 10 is experiencing a high-side fault by taking a ratio of the running current to the baseline current (FIG. 8). If the ratio is approximately 1.4 or greater, the controller 110 determines that the compressor 10 is experiencing a high-side fault. If a high-side fault condition is determined, the controller 110 may then identify cycling of the high-pressure cutout switch (84) if the compressor ON time is less than approximately three (3) minutes and the compressor OFF time is less than approximately seven (7) minutes, as set forth in FIG. 8. The controller 110 may then record the cycling of the high-pressure cutout switch 84 on a plot of fault severity over time, as shown in FIG. 11. Other high-side fault events such as tripping of the motor protector 91 (C1A) can also be determined if compressor ON time is less than approximately thirty (30) minutes and compressor OFF time is approximately greater than seven (7) minutes. The controller 110 can also identify short cycling of the motor protector 91 (C2) if the ON time of the compressor is approximately less than fifteen (15) minutes and the OFF time of the compressor 10 is approximately greater than seven (7) minutes.

Monitoring the high-side fault events over time such that the controller 110 records the historical fault information of such high-side fault events in the memory 89 of the controller 110 allows the controller 110 to determine when to lock out operation of the compressor 10, as set forth below in Table 2.

TABLE 2

| High-Side Fault Events Combination | No. of Events | Severity Level for Protection |
|---|---|---|
| CR | 1 | no action |
| HPCO | 1 | lock out if HPCO > 30x per day |
| C1A | 1 | lock out if C1A > 20x within 7 days |
| C2 | 1 | lock out if C2 > 4x consecutive or 10x/day |
| HPCO + C1A | 2 | lock out if C1A > 20x within 2 days |
| HPCO + C2 | 2 | lock out if C2 > 3x per day |
| C1A + C2 | 2 | lock out if C2 > 3x per day |
| HPCO + C1A + C2 | 3 | lock out if C2 > 1x per day |

As set forth above in Table 2, the controller 110 may lock out the compressor 10 via the power-interruption system 90 if the controller 110 determines cycling of the high-pressure cutout switch (HPCO; 84) along with twenty (20) or more long motor protector trip cycles (C1A) within two (2) days. Likewise, the controller 110 may lock out the compressor 10 if the high-pressure cutout switch (HPCO; 84) cycles thirty (30) or more times in one (1) day. Various other conditions (i.e., pattern of single high-side-fault events or combination of high-side-fault events) may cause the controller 110 to lock out the compressor 10, as shown in Table 2 above.

The controller 110 may determine when to lock out operation of the compressor 10 via the power-interruption system 90 based on the type of high-side event, the number of high-side fault events, and/or the historical fault data over time for the particular high-side fault events. As such, the controller 110 is able to lock out operation of the compressor 10 with certainty and avoid so-called "nuisance" lock out events.

The controller 110 my also include a time-binding requirement, whereby the chain of low-side fault events and high-side fault events must occur within a particular time frame. In one configuration, the controller 110 may require all of the events occurring for either the low-side faults event chain (FIG. 10) or the events occurring in the high-side fault events chain (FIG. 11) to occur within the same four-month season.

In sum, the severity progression of the high-side fault events is monitored by the controller 110 by monitoring and detecting an increasing current rise after start up of the compressor 10 and a decreasing compressor ON time before the motor protector 91 trips. Conversely, the severity of the low-side fault events is identified by the controller 110 by detecting a lack of high relative current rise following start up of the compressor 10 and a decreasing compressor ON time before the motor protector 91 trips.

By tracking the low-side fault events chain (FIG. 10) and tracking the high-side fault events chain (FIG. 11) over time, the controller 110 may also determine the speed with which the low-side fault/condition or the high-side fault/condition is progressing over time. For example, moving from a long cycle run time (C1) to a motor protector trip cycle (C1A) in a low-side fault events chain is an acceleration of a low-side fault/condition and provides an indication to the controller 110 as to how fast this change shifted over time. If the low-side fault events remain the same (i.e., remains a long cycle run time (C1)), the controller 110 can determine that the event has not accelerated.

In addition to the foregoing low-side fault events and high-side fault events, the controller 110 can also determine a loss of lubrication should the current sensor 80 indicate a sudden increase in current. In one configuration, if the current sensor 80 indicates that the increase in current drawn by the electric motor 32 is equal to or greater than approximately forty (40) percent, the controller 110 determines that the compressor 10 is experiencing a loss of lubrication and will lock out operation of the compressor 10 to prevent damage.

With particular reference to FIG. 12, the controller 110 can also monitor and detect electrical-fault conditions and can generate an electrical fault events chain. As described above, the controller 110 monitors the initial current drawn by the electric motor 32 following start up of the compressor 10 to differentiate between a high-side fault and a low-side fault. Because electrical circuit faults typically occur within the first few seconds following start up of the compressor 10, the controller 110 can also determine electrical circuit faults by monitoring the current drawn by the compressor motor 32 immediately following start up of the compressor 10.

As set forth below, using the low-side fault chain (FIG. 10) and the high-side fault chain (FIG. 11), a locked-rotor condition (C4) can be determined by the controller 110 in advance of such a locked-rotor condition (C4) actually occurring. By monitoring the low-side fault events chain (FIG. 10) and the high-side fault events chain (FIG. 11) the controller 110 should prevent a locked-rotor condition (C4) from ever occurring. While a locked-rotor condition should be prevented by monitoring the events of FIGS. 10 and 11, the controller 110 could also monitor an electrical fault events chain (FIG. 12) to selectively lock out operation of the compressor 10 and ensure prevention of a locked-rotor condition (C4).

Initially, the controller 110 monitors an open-start condition (C6) and an open-run circuit condition (C7) by using the current sensor 80 wired through a run circuit (not shown) of the compressor 10. As such if a start circuit (not shown) of the compressor 10 is open while the demand signal (Y) is present, the electric motor 32 would have difficulty starting with just the run circuit and would result in a locked-rotor condition (C4) eventually tripping within approximately fifteen (15) seconds following start up of the compressor 10. Prior to allowing the lock-rotor event (C4) to occur, the controller 110 can detect that there is current in the run circuit via the current sensor 80 and, followed by an alert code of a lock-rotor condition (C4) within approximately fifteen (15) seconds following startup of the compressor 10, can flag an open-start condition (C6) and identify an open-start circuit. Should the controller 110 detect a sudden current rise (i.e., approximately on the order of 1.5×) after the initial fifteen (15) seconds of compressor operation and without a dip in pilot voltage, the controller 110 can determine a sudden loss of lubrication and shut down the compressor 10 (FIG. 12).

Conversely, if the run circuit is open while the controller 110 receives the demand signal (Y), the controller 110 can directly determine that there is no run current, as the current sensor 80 is part of the run circuit. As such, the controller 110 can flag an open-run circuit condition (C7) corresponding to an open-run circuit. As shown in FIG. 12, the various electrical-circuit fault conditions (C4, C6, C7) are outlined along with logic that may be incorporated into the controller 110.

In sum, the controller 110 protects the compressor 10 with minimal "nuisance" interruptions, as the controller 110 not only diagnosis the fault events but also "predicts" the fault/system condition severity progression level. The controller 110 utilizes the current sensor 80 and the thermostat-demand signal (Y) to identify fault events associated with the repeated trips of the various protective limit devices embedded in the system (i.e., high and low pressure switches 82, 84) or in the compressor 10 (i.e., motor protector 91).

The controller 110 tracks and "predicts" the severity level of the fault/system condition by (1) monitoring and differentiating the various types of fault events; (2) linking the chain of events to validate a system low-side or high-side fault and "predicting" the severity level of the fault/system condition based on the order sequence or the combination of the types of fault events making up the chain; (3) disengaging the compressor contactor based on a predetermined severity level to prevent compressor malfunction; (4) visually displaying the fault type and the severity level; and (5) storing the data into history memory.

Those skilled in the art may now appreciate from the foregoing that the broad teachings of the present disclosure may be implemented in a variety of forms. Therefore, while this disclosure has been described in connection with particular examples thereof, the true scope of the disclosure should no be so limited since other modifications will become apparent to the skilled practitioner upon a study of the drawings, the specification and the following claims.

What is claimed is:

1. A diagnostic system for a compressor including a compression mechanism and a motor, the diagnostic system comprising processing circuitry and memory and operable to differentiate between a low-side fault and a high-side fault by monitoring a rate of current rise drawn by said motor for a first predetermined time period following compressor startup, said diagnostic system operable to predict a severity level of a compressor condition based on a fault history stored in said memory, said processing circuitry differentiates amongst cycling of a high-pressure cutout switch, cycling of a low-pressure cutout switch, and cycling of a motor protector based on said rate of current rise in combination with an ON time of the compressor and an OFF time of the compressor.

2. The diagnostic system of claim 1, wherein said rate of current rise is determined by calculating a ratio of a running current drawn by said motor during said first predetermined time period over a stored reference current value taken during a second predetermined time period.

3. The diagnostic system of claim 2, wherein said first predetermined time period is approximately three (3) to five (5) minutes.

4. The diagnostic system of claim 2, wherein said second predetermined time period is approximately seven (7) to twenty (20) seconds following said compressor startup.

5. The diagnostic system of claim 2, wherein said processing circuitry declares the high-side fault if said ratio exceeds approximately 1.4 during said first predetermined time period.

6. The diagnostic system of claim 2, wherein said processing circuitry declares the low-side fault if said ratio is less than approximately 1.1 during said first predetermined time period.

7. The diagnostic system of claim 1, wherein said processing circuitry is operable to predict said severity level of said compressor condition based on at least one of a sequence of historical compressor fault events and a combination of the types of said historical compressor fault events.

8. The diagnostic system of claim 1, wherein said rate of current rise is determined by calculating a ratio of a running current drawn by said motor during said first predetermined time period over a stored reference current value taken during a second predetermined time period.

9. The diagnostic system of claim 8, wherein said processing circuitry declares the high-side fault if said ratio exceeds approximately 1.4 during said first predetermined time period and declares the low-side fault if said ratio is less than approximately 1.1 during said first predetermined time period.

10. A diagnostic system for a compressor including a compression mechanism and a motor, the diagnostic system comprising processing circuitry and memory and operable to differentiate between a low-side fault and a high-side fault by monitoring a rate of current rise drawn by said motor for a first predetermined time period following compressor startup, wherein said processing circuitry is operable to predict a severity level of a compressor condition based on at least one of a sequence of historical compressor fault events and a combination of the types of said historical compressor fault events.

11. The diagnostic system of claim 10, wherein said rate of current rise is determined by calculating a ratio of a running current drawn by said motor during said first predetermined time period over a stored reference current value taken during a second predetermined time period.

12. The diagnostic system of claim 11, wherein said first predetermined time period is approximately three (3) to five (5) minutes.

13. The diagnostic system of claim 11, wherein said second predetermined time period is approximately seven (7) to twenty (20) seconds following said compressor startup.

14. The diagnostic system of claim 2, wherein said processing circuitry declares the high-side fault if said ratio exceeds approximately 1.4 during said first predetermined time period.

15. The diagnostic system of claim 2, wherein said processing circuitry declares the low-side fault if said ratio is less than approximately 1.1 during said first predetermined time period.

16. The diagnostic system of claim 10, wherein said processing circuitry differentiates amongst cycling of a high-pressure cutout switch, cycling of a low-pressure cutout switch, and cycling of a motor protector based on said rate of current rise in combination with an ON time of the compressor and an OFF time of the compressor.

17. The diagnostic system of claim 16, wherein said rate of current rise is determined by calculating a ratio of a running current drawn by said motor during said first predetermined time period over a stored reference current value taken during a second predetermined time period.

18. The diagnostic system of claim 17, wherein said processing circuitry declares the high-side fault if said ratio exceeds approximately 1.4 during said first predetermined time period and declares the low-side fault if said ratio is less than approximately 1.1 during said first predetermined time period.

19. A compressor comprising a shell, a compression mechanism, a motor, and a diagnostic system, said diagnostic system including processing circuitry and memory and operable to differentiate between a low-side fault and a high-side fault by monitoring a rate of current rise drawn by said motor for a first predetermined time period following compressor startup, said diagnostic system operable to predict a severity level of a compressor condition based on a fault history stored in said memory, said processing circuitry differentiates amongst cycling of a high-pressure cutout switch, cycling of a low-pressure cutout switch, and cycling of a motor protector based on said rate of current rise in combination with an ON time of the compressor and an OFF time of the compressor.

20. The compressor of claim 19, wherein said processing circuitry is operable to predict said severity level of said compressor condition based on at least one of a sequence of historical compressor fault events and a combination of the types of said historical compressor fault events.

* * * * *